US008826920B2

(12) United States Patent
Baker et al.

(10) Patent No.: US 8,826,920 B2
(45) **Date of Patent: *Sep. 9, 2014**

(54) APPLICATOR FOR APPLYING A HAIR TREATMENT COMPOSITION TO A BUNDLE OF HAIR STRANDS

(71) Applicant: The Procter & Gamble Company, Cincinnati, OH (US)

(72) Inventors: Paul Edmund Baker, Silchester (GB); Paul James Smith, Twickenham (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,425

(22) Filed: Jul. 3, 2013

(65) Prior Publication Data

US 2013/0298935 A1 Nov. 14, 2013

Related U.S. Application Data

(62) Division of application No. 12/135,275, filed on Jun. 9, 2008, now Pat. No. 8,499,769.

(30) Foreign Application Priority Data

Jun. 15, 2007 (EP) ..... 07110391

(51) Int. Cl.

| | |
|---|---|
| ***A45D 19/18*** | (2006.01) |
| ***A61Q 5/08*** | (2006.01) |
| ***A45D 19/02*** | (2006.01) |
| *A45D 19/00* | (2006.01) |

(52) U.S. Cl.
CPC .... *A45D 19/0008* (2013.01); *A45D 2019/0091* (2013.01); *A45D 19/02* (2013.01)
USPC ..... 132/208; 132/320; 132/270

(58) Field of Classification Search
USPC ..... 132/202, 208, 108, 109, 112, 110, 270
See application file for complete search history.

(56) References Cited

U.S. PATENT DOCUMENTS

| | | | |
|---|---|---|---|
| 2,272,409 | A | 2/1942 | Johnson |
| 2,310,295 | A | 2/1943 | Keele |
| 2,776,667 | A | 1/1957 | Fitzgerald |
| 3,030,968 | A | 2/1960 | Oberstar |

(Continued)

FOREIGN PATENT DOCUMENTS

| | | | |
|---|---|---|---|
| DE | 662702 | C1 | 7/1938 |
| DE | 197639177 | U1 | 4/1977 |

(Continued)

*Primary Examiner* — Rachel Steitz
(74) *Attorney, Agent, or Firm* — James T. Fondriest

(57) ABSTRACT

The present invention relates to an applicator (1) for applying a hair treatment composition. The applicator (1) comprises a plate (10) and a containment portion (20) movably joined by a connection (30) so that said applicator (1) may alternate between a closed state and an open state. A first fin (50), preferably a first (50) and a second (60) fin, projects from the substantially flat internal surface (101) of the plate (10) and bend the hair strand into the containment portion (20) while the applicator (1) is in use. The hair treatment applicator according to the invention allows for precise, non-messy and even application of a hair treatment composition to the hair, in particular to a hair strand and preferably to a bundle of hair strands.

17 Claims, 9 Drawing Sheets

(56) References Cited

U.S. PATENT DOCUMENTS

| | | | | |
|---|---|---|---|---|
| 2,962,031 | A | 11/1960 | Bumgarner | |
| 3,662,767 | A | 5/1972 | Murtha | |
| 3,702,508 | A | 11/1972 | Netter | |
| 3,921,647 | A | 11/1975 | Fisher | |
| 4,020,854 | A | 5/1977 | Caruso | |
| 4,108,184 | A | 8/1978 | Morganroth | |
| 4,398,549 | A | 8/1983 | Thomas | |
| 4,503,870 | A | 3/1985 | Peterson | |
| 4,796,812 | A | 1/1989 | Grollier | |
| 4,942,893 | A | 7/1990 | Trottier | |
| 5,042,514 | A | 8/1991 | Bastien | |
| 5,060,679 | A | 10/1991 | Armand | |
| 5,279,313 | A | 1/1994 | Clausen | |
| 5,535,764 | A | 7/1996 | Abramson | |
| 5,554,197 | A | 9/1996 | Assini | |
| 5,771,906 | A | 6/1998 | De Benedictis | |
| 5,823,204 | A | 10/1998 | Todd | |
| 5,848,730 | A | 12/1998 | Kawase | |
| 5,971,645 | A | 10/1999 | Fukushima | |
| 6,062,231 | A | 5/2000 | De LaForcade | |
| 6,148,829 | A | 11/2000 | De Benedictis | |
| 6,250,312 | B1 | 6/2001 | Dasilva | |
| 6,427,701 | B1 | 8/2002 | Roth | |
| 6,440,175 | B1 | 8/2002 | Stanley | |
| 6,626,599 | B2 | 9/2003 | Delaforcade | |
| 6,748,957 | B1 | 6/2004 | Giordano | |
| 7,025,069 | B2 | 4/2006 | Thiebaut | |
| 7,198,049 | B2 | 4/2007 | Elmer | |
| 7,357,137 | B2 | 4/2008 | Husband | |
| 7,425,220 | B2 | 9/2008 | Barrass | |
| 7,475,688 | B2 | 1/2009 | Colacioppo | |
| 7,543,591 | B1 | 6/2009 | Munsil | |
| 7,640,939 | B2 | 1/2010 | Ploix | |
| 2002/0114657 | A1 | 8/2002 | Gueret | |
| 2002/0142027 | A1 | 10/2002 | Gueret | |
| 2002/0197228 | A1 | 12/2002 | Lasala | |
| 2003/0007825 | A1 | 1/2003 | De LaForcade | |
| 2004/0016064 | A1 | 1/2004 | Vena | |
| 2004/0031502 | A1 | 2/2004 | Winckels | |
| 2004/0089316 | A1 | 5/2004 | Hamilton | |
| 2004/0182408 | A1 | 9/2004 | De LaForcade | |
| 2005/0079192 | A1 | 4/2005 | Simon | |
| 2005/0207153 | A1 | 9/2005 | Leleve | |
| 2005/0211599 | A1 | 9/2005 | De LaMettrie | |
| 2006/0042643 | A1 | 3/2006 | Delan | |
| 2006/0064824 | A1 | 3/2006 | Godfrey | |
| 2006/0090771 | A1 | 5/2006 | Ramet | |
| 2006/0144415 | A1 | 7/2006 | Magee | |
| 2006/0207036 | A1 | 9/2006 | Kennedy | |
| 2007/0144550 | A1 * | 6/2007 | Roher | 132/208 |
| 2007/0215170 | A1 | 9/2007 | Kennedy | |
| 2007/0227620 | A1 | 10/2007 | Kunii | |
| 2008/0000492 | A1 | 1/2008 | Mills | |
| 2008/0083418 | A1 | 4/2008 | Glenn | |
| 2008/0083419 | A1 | 4/2008 | Glenn | |
| 2008/0083420 | A1 | 4/2008 | Glenn | |
| 2008/0087292 | A1 | 4/2008 | Abergel | |
| 2008/0087293 | A1 | 4/2008 | Glenn | |
| 2008/0087294 | A1 | 4/2008 | Glenn | |
| 2008/0110929 | A1 | 5/2008 | Stanley | |
| 2008/0156817 | A1 | 7/2008 | Roseblade | |
| 2008/0196734 | A1 | 8/2008 | Husband | |
| 2008/0223386 | A1 | 9/2008 | Albisetti | |
| 2008/0223391 | A1 | 9/2008 | Baker | |
| 2008/0223393 | A1 | 9/2008 | Boyle | |
| 2008/0257370 | A1 | 10/2008 | Perry | |
| 2008/0308119 | A1 | 12/2008 | Smith | |
| 2009/0050171 | A1 | 2/2009 | Barrass | |
| 2009/0071496 | A1 | 3/2009 | Glenn | |
| 2009/0084393 | A1 | 4/2009 | Baker | |
| 2009/0084394 | A1 | 4/2009 | Baker | |
| 2009/0084395 | A1 | 4/2009 | Glenn | |
| 2009/0095314 | A1 | 4/2009 | Lund | |
| 2009/0101159 | A1 | 4/2009 | Bonnafous | |
| 2009/0152281 | A1 | 6/2009 | Bowes | |
| 2009/0223531 | A1 | 9/2009 | Lund | |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 10290712 | A | 11/1998 |
| JP | 11-178630 | | 7/1999 |
| JP | 11-178639 | A | 7/1999 |
| JP | 2001-211925 | A | 8/2001 |
| JP | 2001523500 | A | 11/2001 |
| JP | 2002-034636 | A | 2/2002 |
| JP | 2003-199623 | A | 7/2003 |
| JP | 2003-310337 | A | 11/2003 |
| JP | 2004338725 | A | 12/2004 |
| JP | 2006043434 | A | 2/2006 |
| JP | 2006082852 | A | 3/2006 |
| JP | 3129205 | U | 2/2007 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

* cited by examiner

APPLICATOR FOR APPLYING A HAIR TREATMENT COMPOSITION TO A BUNDLE OF HAIR STRANDS

FIELD OF THE INVENTION

The present invention relates to an applicator which allows for precise, non-messy and even application of a cosmetic composition to fibres, preferably keratinous fibres. The applicator according to the invention is especially intended for hair treatment compositions to provide hair strand effects.

BACKGROUND OF THE INVENTION

Application of hair treatment compositions to distinct hair strands allows the user to achieve a different look than a full head application. Hair treatment compositions for providing a hair strand effect include highlighting compositions, dyeing compositions, perming compositions, styling compositions and mixtures thereof.

Hair strand effects such as those provided by highlighting compositions and dyeing compositions must be precisely applied where desired. For example, if a too abundant amount of highlighting composition is applied to the root, it may transfer to the neighbouring unselected hair strands. This may alter the overall end result and may totally disrupt the pattern that the user has tried to create. In addition, hair treatment compositions such as highlighting and dyeing compositions comprise strong oxidants to bleach the melanin pigments. In view of its reactive chemical nature, most applications of highlighting and dyeing compositions if unexpectedly delivered in excess to the root-line, may also transfer to the scalp which can lead in some cases to unnecessary skin irritation. In addition, if an excessive amount of product is applied to the root, the colour effect will not be consistent along the length of the hair, leading to an undesired visual effect. If, instead, insufficient composition is applied to the hair strands, the evenness of the hair strand effect may not be achieved producing an end result which is visually unacceptable. Hence it is important that a consistent amount of product is applied uniformly along the hair strands being treated.

One known method for providing hair strand effects such as highlighting is the cap and hook system. A cap, provided with holes, is positioned over the head and hair strands are pulled out with a hook. Far from being accurate, the cap and hook system suffers from several drawbacks including random selection of the hair strands via the holes on the cap and the likelihood of applying the highlighting composition to only a portion of the selected hair strands and not to the root portion.

Several hair treatment applicators have been designed for application of a hair treatment composition to independent bundles of hair strands as alternatives to the cap and hook system. These applicators belong to two general fields. One field comprises applicators based on combs and/or brushes. The other group comprises applicators having two articulated portions which are movable one relative to the other. Many attempts have been disclosed in this later field. U.S. Pat. No. 3,030,968 refers to an applicator for liquid treating material to be loaded by immersion. This applicator comprises a trough and a hair guide member mounted on the ends of the legs of a U-shaped resilient spring. The spring allows for manual compression and permits the hair guide member to fit into the trough. U.S. Pat. No. 6,062,231 discloses a device for applying a hair product to hair strands. This device comprises two articulated portions; the application means to be loaded by immersion and the retaining member to keep the hair strands on the applicator means while the device is in use. Another attempt is shown in US2003/0024544 wherein a device is disclosed provided with a cavity for the hair product and a retention member which is elastically deformable. The retention member may comprise porous or fibrous material and the cavity is provided with at least one notch to keep the hair strands in position during the application of the hair treatment composition.

It is generally recognized that self-application of a composition to achieve hair strand effects are difficult per se, in particular those for highlighting and dyeing. To achieve the expected end results, a hair treatment applicator capable of facilitating the self-application of a hair treatment composition needs to be conceived to address several technical challenges.

Firstly, the hair treatment applicator should apply an amount of hair treatment composition, which is sufficient to provide a hair strand effect without transferring to neighbouring strands or the scalp and skin.

Secondly, the hair treatment applicator should not apply but then subsequently scrape off the hair treatment composition while the user moves the applicator along the bundle of hair strands.

Thirdly, highlighting and dyeing compositions in particular, are formulated so as to stay in place for a period of time long enough for the chemistry contained therein to provide the effects to the keratinous fibres. The hair treatment applicator should thus be designed to readily apply hair treatment compositions typically formulated as gel, cream or paste avoiding displacement and dripping out of the applicator while the user treats the hair.

Fourthly, the whole application process should occur in a tidy and clean fashion without hair treatment composition being inadvertently displaced out of the hair treatment applicator.

In addition, the hair treatment applicator should not let the hair treatment composition remain unused or sequestered within the applicator. If the hair treatment composition is visually sequestered, it may increase the signal for the user to reload thus inducing the user to load more hair treatment composition than the device may contain, leading to an increased risk of mess for the user during the application of the hair treatment composition.

Moreover, the hair treatment applicator should evenly apply the composition to independent bundles of hair strands. Evenness is very important when the composition is a highlighting or dyeing composition. The permanent effect provided by these compositions is not immediately visible after the application and if the result is not appealing, it is not easily reversed. A hair treatment applicator should hence ensure homogeneous coating along the length and width of the bundle of hair strands and likewise on the front and rear surfaces.

Finally, an applicator for hair treatment compositions should be easy to use; it should be doubtless cheap and easy to produce and it should not require any special experience and training in matters such as how much and where to load the hair treatment composition. Ideally, the consumer should be able to load and use the applicator by simply following a few instructions provided by the manufacturer.

Thus, what still remains to be solved in the art is an applicator capable of overcoming the technical problem defined above.

It has now been found that an applicator (as defined herein after) can significantly improve the application of hair treatment composition to provide hair strand effects.

SUMMARY OF THE INVENTION

According to the invention, an applicator (1) for applying a hair treatment composition to the hair is provided comprising a plate (10) and a containment portion (20); wherein said plate (10) has a perimeter (103), a substantially flat internal surface (101) and an external surface (102); wherein said containment portion (20) comprises a base (201) and a wall (202), said wall (202) emerging from said base (201) and extending upwardly, said wall (202) having a rim (222) and said rim (222) defining an opening (203) and an internal volume (204) of said containment portion (20); wherein said plate (10) and said containment portion (20) are movably joined by a connection (30) so that said applicator (1) may alternate between a closed state and an open state, wherein when said applicator (1) is in a closed state, said substantially flat internal surface (101) of said plate (10) is in a juxtaposed relationship to said opening (203) of said containment portion (20) and wherein when said applicator (1) is in an open state, said substantially flat internal surface (101) of said plate (10) is in a distal relationship to said opening (203) of said containment portion (20); wherein a first fin (50) projects from said substantially flat internal surface (101) of said plate (10) and forms with said substantially flat internal surface (101) an acute angle α of from 25° to 55°; wherein said first fin (50) extends for an average first length (L1) of from 1 mm to 50 mm; wherein said first fin (50) comprises a proximal edge (501) and a distal edge (502); wherein said proximal edge (501) is attached to said substantially flat internal surface (101) of said plate (10).

Furthermore, a method to treat the hair by means of the hair treatment applicator (1), a kit comprising the hair treatment applicator (1) and the use of a hair treatment composition to provide a hair strand effect with a hair treatment applicator (1) according to the invention are also described.

Finally, according to the invention, the use of the hair treatment applicator (1) to apply a hair treatment composition to a hair strand, preferably to a bundle of hair strands, is provided, wherein said use comprises to locate said hair strand straight between a plate (10), which comprises a first fin (50), preferably a first (50) and a second (60) fin, and a containment portion (20) and then to bend with said first fin (50), preferably with said first (50) and second (60) fin, said hair strand, preferably said bundle of hair strands, within said containment portion (20).

DETAILED DESCRIPTION OF THE INVENTION

The present invention is characterized by the synergistic relationship that the features as described herein have when combined together in the specific relationship selected within the present invention to solve the above technical problem.

For the purpose of this invention, the term hair refers to both living hair i.e. on a living body and to non-living hair i.e. in a wig, hairpiece or other aggregation of non-living keratinous fibre. Mammalian, preferably human hair is intended.

For the purpose of this invention, the term "hair strand" means a single keratinous fibre, and the term "bundle of hair strands" means a plurality of hair strands according to the meaning given herein.

Figure 1A:
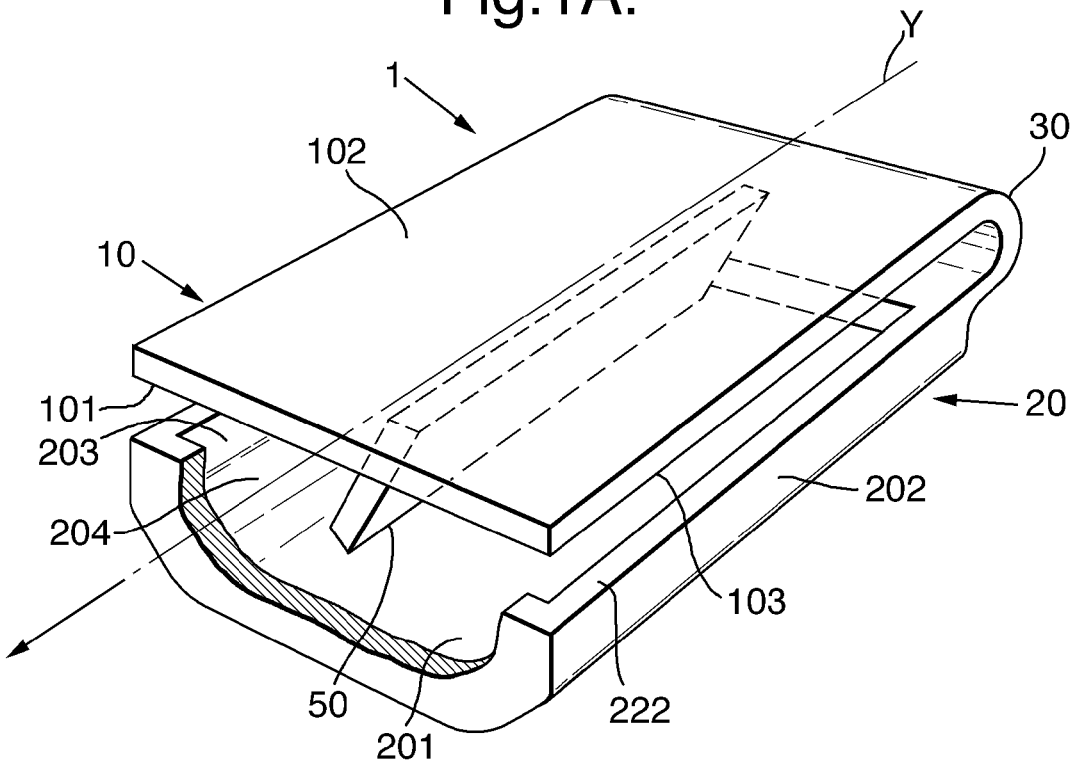
FIG. 1A is a perspective view of an embodiment of the applicator according to the invention. The applicator (1) is shown in a closed state. The plate (10), which comprises an external surface (102), a substantially flat internal surface (101) and a perimeter (103), is connected to the containment portion (20) via a connection (30). The plate (10) comprises an axis Y. Part of the containment portion (20) has been removed from this picture to show a first fin (50), which projects along axis Y from the substantially flat internal surface (101) of the plate (10). The containment portion (20) comprises a base (201) and a wall (202). The rim (222) of the wall (201) defines an opening (203) and an internal volume (204) of the containment portion (20).

To achieve the technical effect described herein, the applicator (1) for applying a hair treatment composition to the hair according to the present invention comprises a plate (10) movably joined by a connection (30) to a containment portion (20) as shown in FIG. 1A. Said plate (10) comprises a perimeter (103), a substantially flat internal surface (101) and an external surface (102). The applicator (1) is characterized by a first fin (50), which projects from said substantially flat internal surface (101) of said plate (10) and extends for an average first length (L1) of from about 1 mm to about 50 mm. Said first fin (50) forms with said substantially flat internal surface (101) of said plate (10) an acute angle α of from about 25° to about 55°. Preferably, a second fin (60) projects from said substantially flat internal surface of said plate (10) independently from said first fin (50) and extends independently for an average second length (L2) of from about 1 mm to about 50 mm. Said second fin (60) forms with said substantially flat internal surface (101) of said plate (10), independently from said first fin (50), an acute angle β of from about 25° to about 55°.

Preferably said acute angle α and/or said acute angle β are from about 35° to about 55°, more preferably from about 35° to about 50°.

Figure 1B:
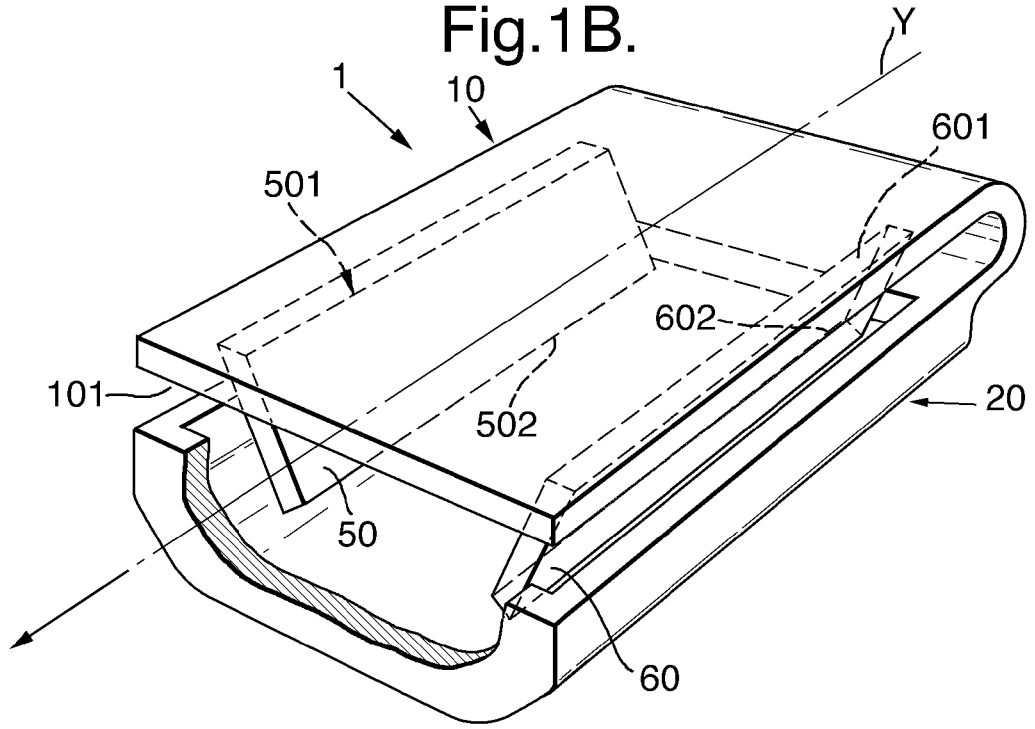
FIG. 1B is a perspective view of an embodiment of the applicator according to the invention, the embodiment shown here being similar to the one shown in FIG. 1A. The applicator (1) is shown in a closed state. Part of the containment portion (20) has been removed from this picture to show a first fin (50) and a second fin (60). The first fin (50) and the second fin (60) project independently from the substantially flat internal surface (101) of the plate (10). Each of said fins (50; 60) comprises a proximal edge (501; 601) and a distal edge (502; 602). The proximal edges (501; 601) are those attached to the substantially flat internal surface (101) of the plate (10) whist the distal edges (502; 602) in this embodiment verge one toward the other.
Figure 1C:
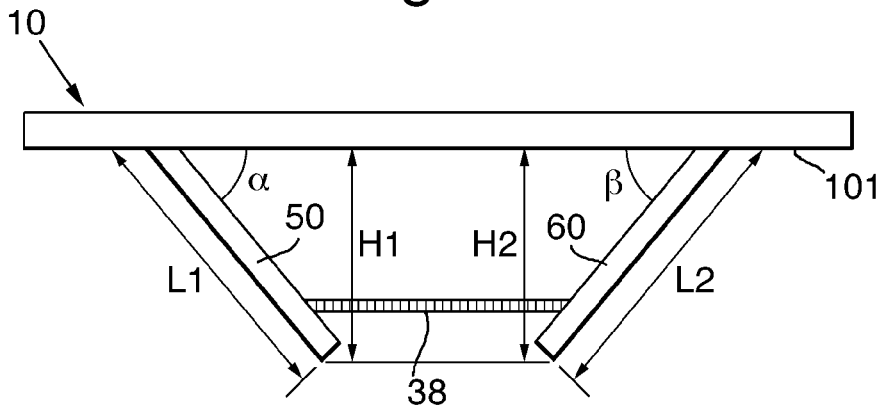
FIG. 1C is a cross-section of the plate (10) of one embodiment according to the invention and the cross-section is transversal to axis Y and to the substantially flat internal surface (101) of the plate (10). Substantially identical first and second fins (50; 60) independently project from the substantially flat internal surface (101) and form each independently with the substantially flat internal surface (101) of the plate (10) substantially identical acute angles α and β. Substantially identical first and second fins (50; 60) independently extend from the substantially flat internal surface (101) of the plate (10) with substantially identical average first length (L1) and average second length (L2). Substantially identical average first height (H1) and average second height (H2) for this embodiment are shown. A joining means (38) connects the first fin (50) with the second fin (60).

Said substantially flat internal surface (101) of said plate (10) of the applicator (1) according to the invention comprises an axis Y, which extends straight from the centre of said substantially flat internal surface (101) of said plate (10) and crosses transversally said connection (30) preferably perpendicular to the connection (30). Each of said first (50) and second (60) fins has a proximal edge (501; 601) and a distal edge (502; 602). Said proximal edges (501; 601) are those attached to said substantially flat internal surface (101) of said plate (10) as shown in FIG. 1B. Preferably, said proximal edge (501) of said first fin (50) is substantially parallel to said proximal edge (601) of said second fin (60). More preferably said distal edges (502; 602) of said first and second fin (50; 60) verge one toward the other as shown in FIG. 1B. Even more preferably, said proximal edge (501) of said first fin (50) and said proximal edge (601) of said second fin (60) are substantially parallel to said axis Y. Said first and second fin (50; 60) project independently from said substantially flat internal surface (101) of said plate (10) and preferably form independently with said substantially flat internal surface (101) substantially identical acute angles α and β as shown in FIG. 1C. More preferably, said first and second fin (50; 60) extend independently for substantially identical average lengths (L1) and (L2) as shown in FIG. 1C.

Figure 3:
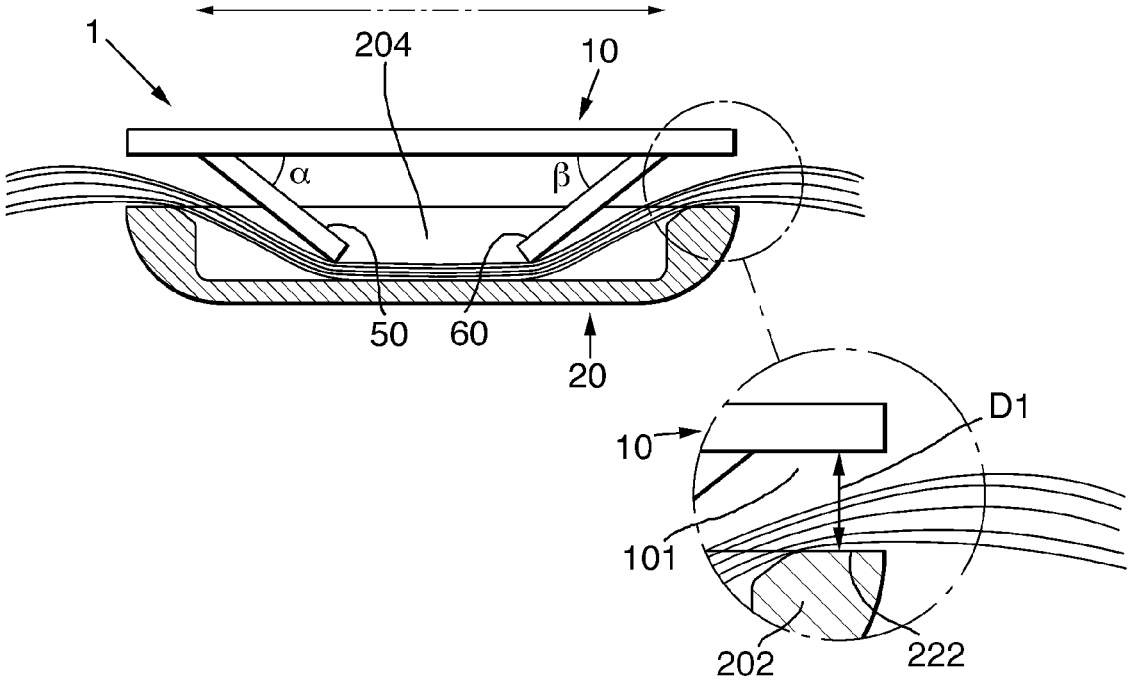
FIG. 3 is a cross-section of one embodiment of the applicator (1) according to the invention. The applicator (1) is in a closed state. The plate (10) comprises an axis Y (not shown herein) and the cross-section is taken transversal to axis Y and to the substantially flat internal surface (101) of the plate (10). A first (50) and a second (60) fin project from the substantially flat internal surface (101) of said plate (10) and form with said substantially flat internal surface (101) substantially identical acute angles α and β. A bundle of hair strands, between said plate (10) and said containment portion (20), is bent by said fins (50; 60) within the internal volume (204) of said containment portion (20). Within the circle the average distance (D1) between the substantially flat internal surface (101) of the plate (10) and the rim (222) of the wall (202) of the containment portion (20) is magnified. The double arrow on the top of FIG. 3 indicates that the applicator (1) is bidirectional.

The containment portion (20) according to the invention is formed by a base (201) and a wall (202), said wall (202) emerging from said base (201) and extending upwardly. Said wall (202) has a rim (222) which defines an opening (203) and an internal volume (204) of said containment portion (20). Thus, the containment portion (20) is provided by any means to contain a hair treatment composition as described above. The containment portion (20) may even be provided by the palm of the user's hand, wherein said connection (30) to said plate (10) is the ball of the thumb. Said plate (10) and said containment portion (20) are movably joined by a connection (30), so that said applicator (1) can alternate from an open state to a closed state. In this latter state, said substantially flat internal surface (101) of said plate (10) is in a juxtaposed relationship to said opening (203) of said containment portion (20). When the applicator (1) is in a closed state, it comprises an average distance (D1) from said substantially flat internal surface (101) of said plate (10) to said rim (222) of said containment portion (20), as shown in FIG. 3. Said average distance (D1) is preferably from about 0.5 mm to about 5 mm, more preferably from about 0.8 mm to about 4.0 mm, even more preferably from about 1.0 mm to about 3.0 mm.

This specific combination of features within the applicator (1) according to the invention provides a solution to the technical problems described above and the coating of hair with a hair treatment composition is achieved providing sufficient but not excessive deposition of the hair treatment composition and allowing an even and non-messy application.

1. Applicator

Said plate (10) and said containment portion (20) of said hair treatment applicator (1) according to the invention are of ergonomic size and can thus fit easily on either hand. The shape of said plate (10) may vary. Rectangular, square, circular, elliptical, oblong shape or combination thereof may be useful as they are easy to manufacture but other shapes, particularly those that are easily recognised by the consumers may also be used.

The perimeter (103) of said plate (10) and the rim (222) of said wall (202) of said containment portion (20) may be curvilinear or sharp. Irrespectively from their shape preferably said perimeter (103) of said plate (10) has substantially the same extension of said rim (222) of said containment portion (20).

Said substantially flat internal surface (101), said external surface (102) of said plate (10) as well as said bottom (201) and said wall (202) of said containment portion (20) may further comprise one or more areas, which have visible and/or tactile differences from said substantially flat internal surface (101) and/or from said external surface (102) and/or from said bottom (201) and/or from said wall (202). Said visible or tactile differences comprise differences in colour and/or shade, differences in patterns, markings and/or embossments. Those visible or tactile differences, differences in colour and/or shade, differences in patterns, markings and/or embossments, in particular those present in the containment portion (20) may be provided to indicate where and how much hair treatment composition should be loaded into the hair treatment applicator (1).

Said internal surface (101) of said plate (10) is substantially flat whilst said external surface (102) of said plate (10), said bottom (201) and said wall (202) of said containment portion (20) may be independently substantially flat or curved. Preferably, the bottom (201) of said containment portion (20) is substantially flat. Said substantially flat internal surface (101) may have a surface area of from about 2 $cm^2$ to 150 $cm^2$ preferably about 2 $cm^2$ to about 70 $cm^2$, more preferably from about 3 $cm^2$ to about 50 $cm^2$, even more preferably from about 4 $cm^2$ to about 30 $cm^2$.

Said plate (10) and/or said containment portion (20) or at least a portion thereof may comprise one or more cavities, one or more V- or U-shaped grooves or combinations thereof. Said cavities or grooves may be independently located on said substantially flat internal surface (101), on said external surface (102), on said bottom (201), on said wall (202) or combinations thereof.

Said plate (10) and said containment portion (20) may be manufactured from any known material or combinations of materials capable of supporting a hair treatment composition. Suitable materials are polymer resins such as a polyolefins e.g. polypropylene, polyethylene or polyethylene terephthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials.

The method of manufacture of said plate (10) and said containment portion (20) may include, but is not limited to, injection moulding, co-injection moulding, over moulding, in-mold assembly, compression moulding, blow moulding, thermo or vacuum forming of a blister type shell and lamination onto a carrier plastic or board material in the horizontal or vertical plane.

A connection (30) movably joins said plate (10) and said containment portion (20). A connection (30) is necessary in the applicator (1) to improve the user's perception of control over the applicator (1) and to allow the user to guide the applicator (1), with the use of either hand, precisely and easily to each bundle of hair strands. In addition, the connection (30) allows the user to move the applicator (1) from one bundle of hair strands to another without having to adjust the position of said plate (10) onto said containment portion (20) after each application.

Figure 2:
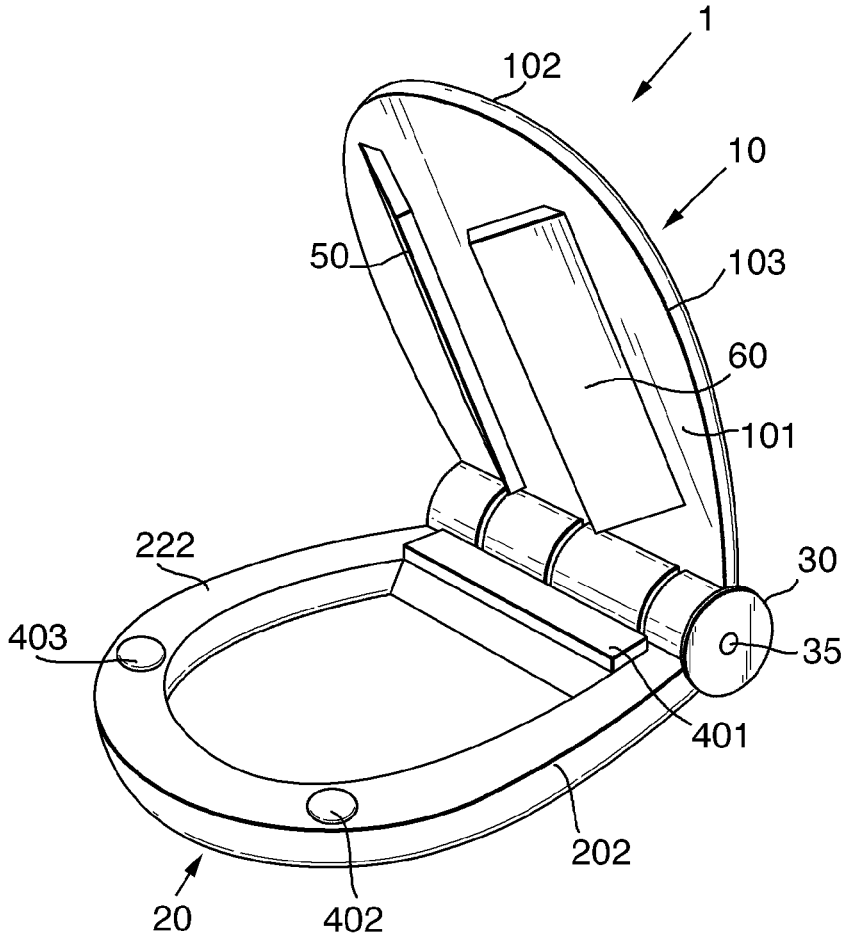
FIG. 2 is a perspective view of one embodiment of the applicator (1) according to the invention. The applicator (1) is shown in an open state. The plate (10) is connected to the containment portion (20) via the connection (30), which comprises a fulcrum (35). The plate (10) comprises a perimeter (103), a substantially flat internal surface (101) and an external surface (102). A first fin (50) and a second fin (60) project independently from the substantially flat internal surface (101) of the plate (10) and each independently has a rectangular shape. A sealing means (401) is shown on the rim (222) of the wall (202) of the containment portion (20) adjacent to the connection (30). Two stop mechanisms, in this embodiment represented by two substantially identical hemispheres (402; 403), are positioned on the rim (222) of the wall (202) of the containment portion (20).
Figure 5A:
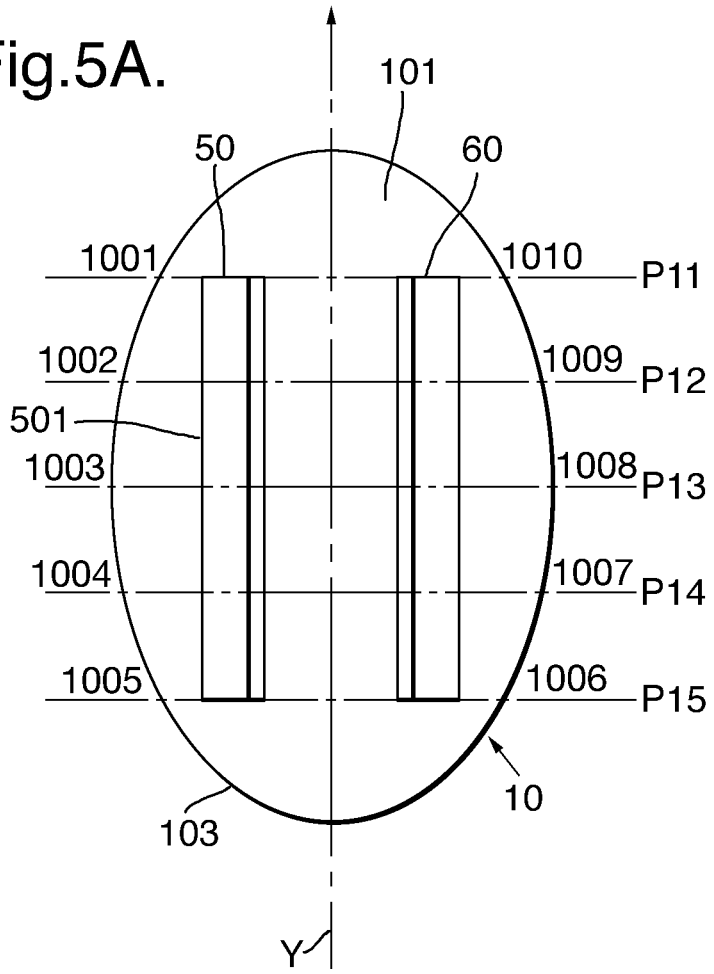
FIG. 5A is a view of the substantially flat internal surface (101) of said plate (10) according to the invention, wherein planes (P11, P12, P13, P14 and P15), perpendicular to axis Y and parallel to said substantially flat internal surface (101) equally divide the proximal edge (501) of said first (50) and second (60) fin. Planes (P11 to P15) intersect said perimeter (103) of said plate (10), identifying ten positions (1001 to 1010) on said perimeter (103) of said plate (10) where to measure the average distance (D1).

A connection (30) between said plate (10) and said containment portion (20) according to the present invention allows the hair treatment applicator (1) to alternate from an open state to a closed state. In one embodiment of said applicator (1) in an open state, as shown in FIG. 2, the angle between said substantially flat internal surface (101) of said plate (10) and the rim (222) of said wall (202) of said containment portion (20) may range between 20° and 275°, preferably between 30° and 190°, more preferably between 40° and 90°. When the applicator (1) is in a closed state, as shown in FIGS. 1A and 1B, said substantially flat internal surface (101) of said plate (10) is in a juxtaposed relationship to said opening (203) of said containment portion (20) and at least a part of said first fin (50), preferably a part of said first (50) and/or said second (60) fin, is within said internal volume (204) of said containment portion (20). Said substantially flat internal surface (101) of said plate (10) has an average distance (D1) from said rim (222) of said wall (202) as shown in FIG. 3. Said average distance (D1) is preferably from about 0.5 mm to about 5.0 mm, more preferably from about 0.8 mm to about 4.0 mm, even more preferably from about 1.0 mm to about 3.0 mm. The average distance (D1) was determined using Mitutoyo Digimatic callipers as described hereafter. When said applicator (1) is in a closed state and said substantially flat internal surface (101) of said plate (10) is in a juxtaposed relationship to said opening (203) of said containment portion (20) a Mitutoyo Digimatic calliper was positioned at the perimeter (103) of said plate (10) and the distance from said rim (222) was measured. This step was repeated for ten different positions. These ten different positions on said perimeter (103) of said plate (10) were the points 1001 to 1010 as shown in FIG. 5A. Planes (P11 to P15) were perpendicular to axis Y and parallel to said substantially flat internal surface (101) of said plate (10). Those five planes (P11 to P15) equally divided said proximal edge (501) of said first fin (50). When a second fin (60) is present, the fin which has the greatest average width (W1; W2) of said proximal edge (501; 601) as described herein below is the fin which is equally divided by those five planes (P11 to P15).

The closed state is the state whereby when a hair strand, preferably a bundle of hair strands is positioned substantially straight between said containment portion (20) and said plate (10), which comprises a first fin (50), preferably a first (50) and a second (60) fin, said hair strand or bundle of hair strands is bent into the internal volume (204) of said containment portion (20) by said first fin (50), preferably by said first fin (50) and said second fin (60) as shown in FIG. 3.

Said plate (10) and said containment portion (20) may pivot about said connection (30) to alternate from an open state to a closed state; in one embodiment, the hair treatment applicator (1) is in an open state and the user applies pressure on the external surface (102) of said plate (10) and on said bottom (201) of said containment portion (20) to bring the applicator (1) in a closed state. To move said plate (10) and said containment portion (20) back from a close state to an open state either said external surface (102) of said plate (10) and said base (201) of said containment portion (20) may be independently provided with one or more fitting means for the user's fingers or the connection (30) itself may re-establish the initial orientation of said plate (10) and said containment portion (20), preferably by springing back. The spring back property should preferably not occur uncontrollably and unexpectedly as it may otherwise injure the user's hand and fingers. Uncontrolled spring back may displace inadvertently the hair treatment composition from the hair treatment applicator (1) causing messiness. The connection (30) should work preferably with applicable pressures suitable for use by most consumers.

The characteristics of said connection (30) may be an intrinsic property of the material used to manufacture said connection (30) or may be provided by the design of the connection (30) itself. The connection (30) should preferably not break or get damaged so as to affect utility within a few applications. The connection (30) should preferably not be too resistant to the applied pressure by the user, otherwise the user's hand and fingers may ache during repetitive use. The connection (30) should also not be too weak or provide little or no perception of guidance over the hair treatment applicator (1).

The plate (10) and the containment portion (20) are connected via any suitable means that fulfils the above described requirements for the connection (30), including the user's hand, for example through the thumb and index finger. In one embodiment, said plate (10) and said containment portion (20) are mounted at the ends of the arms of a tweezers-like or tong-like connection (30). In another embodiment said plate (10) and said containment portion (20) are connected via one or more hinges, preferably one hinge. Said connection (30) may comprise a fulcrum (35) as shown in FIG. 2. More preferably, said connection (30) is contiguous and located adjacently to said perimeter (103) of said plate (10) and to said rim (222) of said containment portion (20). Said one or more hinges can be formed in a number of ways including: a "live" injection moulded hinge, a co-injected hinge, an over moulded hinge, in-mold assembly, a leaf spring or any other appropriate spring assembly, a strap hinge, a fold formed by a kiss-cut, score or crease.

In certain embodiments both said plate (10) and said containment portion (20) have a female part of the hinge incorporated in their design. The female part of the hinge is created during the manufacture process for said plate (10) and for said containment portion (20), for example during the injection moulding process. A pin is designed to fit both female parts of the hinge created on said plate (10) and said containment portion (20). The pin, preferably of rectangular shape, is manufactured from a polymer resin such as polyolefin, preferably polypropylene. The pin is assembled into the female parts of said plate (10) and said containment portion (20) to create the hinge.

In certain embodiments, both said plate (10) and said containment portion (20) may be manufactured within the same injection mould for example from polypropylene. A living hinge also made from polypropylene may be created between said plate (10) and said containment portion (20). Polypropylene may be used to provide a living hinge that can be flexed multiple times without breakage. The living hinge is typically closed during the de-moulding process.

In certain embodiments, both said plate (10) and said containment portion (20) may be manufactured within the same injection mould for example from polypropylene and a hinge can be created by co-injection, in-mold assembly or overmoulding of a thermo plastic elastomer or a thermo plastic vulcanate or any other material that can be used to provide a hinge with the properties listed above.

2. Fins

The applicator (1) according to the invention comprises a first fin (50), preferably a first and a second fin (60), which independently project from said substantially flat internal surface (101) of said plate (10). The term "fin" within the scope of the present invention defines a strip or sheet of material, preferably of substantially constant thickness as described below. The form of said first (50) and/or second (60) fin may vary; preferably said first (50) and/or second (60) fin have the form of a parallelepiped wherein two of the six faces extend for an area which is at least two times greater, more preferably five times greater, than the area of any of the other four faces. Those two faces have preferably a substantially flat surface. The shape of said first (50) and second (60) fin may vary. Rectangular, square, circular, elliptical, oblong or combination thereof may be useful. A rectangular shape as shown in FIGS. 1 to 3 is preferred.

When said applicator (1) comprises only one fin, said fin is called first fin (50) and the acute angle that said first fin (50) forms with said substantially flat internal surface (101) of said plate (10) is called acute angle $\alpha$; when said applicator (1) comprises two fins, said fins are called first (50) and second (60) fin. The acute angle formed by said second fin (60) is called acute angle $\beta$ to distinguish it from acute angle $\alpha$.

As shown in FIG. 1A, a first fin (50) projects from said substantially flat internal surface (101) of said plate (10) and extends for an average first length (L1) of from about 1 mm to about 50 mm, preferably from about 2 mm to about 25 mm, more preferably from about 3 mm to about 15 mm. Said first fin (50) forms with said substantially flat internal surface (101) of said plate (10) an acute angle $\alpha$ of from about 25° to about 55°. Preferably said acute angle $\alpha$ is from about 35° to about 55°, more preferably from about 35° to about 50°.

Preferably, a second fin (60) projects from said substantially flat internal surface (101) of said plate (10) independently from said first fin (50) as shown in FIGS. 1B, 1C and 2, and extends independently from said first fin (50) for an average second length (L2) of from about 1 mm to about 50 mm, preferably from about 2 mm to about 25 mm, more preferably from about 3 mm to about 15 mm. Said second fin (60) forms with said substantially flat internal surface (101) of said plate (10) an acute angle $\beta$ of from about 25° to about 55°, independently from said acute angle $\alpha$ formed by said first fin (50). Preferably said acute angle $\beta$ is from about 35° to about 55°, more preferably from about 35° to about 50°.

Each of said first (50) and second (60) fin has a proximal edge (501; 601) and a distal edge (502; 602). Said proximal edges (501; 601) are those attached to said substantially flat internal surface (101) of said plate (10) a shown in FIG. 1B. Said distal edges (502; 602) may be sinusoidal or crenellated; preferably said distal edges (502; 602) are straight and their profiles may be curvilinear or sharp. Said proximal edges (501; 601) are each independently delimited by an average width (W1) for said first fin (50) and an average width (W2) for said second fin (60) and each independently by an average thickness (T1) for said first fin (50) and an average thickness (T2) for said second fin (60). Said average widths (W1) and (W2) are preferably of from about 20 cm to about 0.5 cm, more preferably between 15 cm and 1.0 cm and even more preferably between 10 cm and 1.5 cm.

Whereas said average thicknesses (T1) and (T2) are preferably from about 5 mm to about 0.1 mm, more preferably from about 4 mm to 0.5 mm and even more preferably from about 3 mm to 0.5 mm.

Preferably, said distal edges (502; 602) have substantially identical average widths (W1; W2) and substantially identical average thicknesses (T1; T2). Said distal edges (501; 601) may have similar dimensions as described above for said proximal edges (502; 602).

According to the present invention, when a first (50) and a second (60) fin are present, the fin which has the greatest average width (W1; W2) of said proximal edge (501; 601) is named first fin (50).

The average first length (L1) and the acute angle α of said first fin (50) trigonometrically define an average first height (H1) of said first fin (50) from said substantially flat internal surface (101) of said plate (10) as shown in FIG. 1C. The average second length (L2) and the acute angle β of said second fin (60) also trigonometrically define an average second height (H2) of said second fin (60) from said substantially flat internal surface (101) of said plate (10) as also shown in FIG. 1C. Said average first height (H1) of said first fin (50) and said average second height (H2) of said second fin (60) are preferably from about 41.0 mm to about 0.4 mm, more preferably from about 20.5 mm to about 0.8 mm and even more preferably from about 12.3 mm to about 1.3 mm.

Said first and second fin (50; 60) may project from said substantially flat internal surface (101) of said plate (10) in any orientation one with respect to the other. Preferably, said first (50) and second (60) fin project from said substantially flat internal surface (101) so that said proximal edge (501) of said first fin (50) is substantially parallel to said proximal edge (601) of said second fin (60). Preferably said proximal edge (501) of said first fin (50), more preferably said proximal edge (501) of said first fin (50) and said proximal edge (601) of said second fin (60) are substantially parallel to said axis Y of said substantially flat internal surface (101) of said plate (10) as shown in FIG. 1B.

Figure 4A:
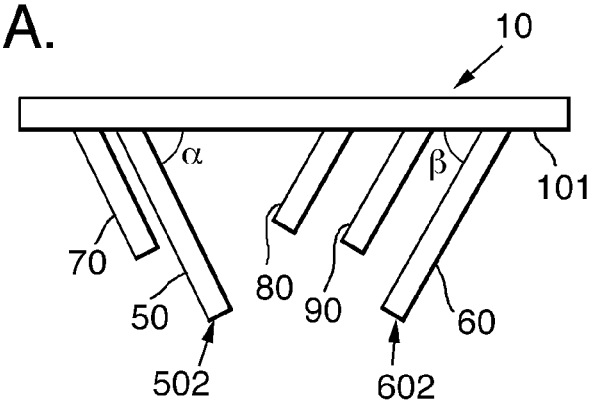
FIG. 4A shows an embodiment of the plate (10) of an applicator according to the invention. A first and a second fin (50; 60) projects independently from the substantially flat internal surface (101) of the plate (10) and form independently with said substantially flat internal surface (10) substantially identical acute angles α and β. Three additional fins (70; 80; 90) project independently one from the others and also independently from said first and second fin (50; 60). The distal edges (502; 602) of the first and second fin (50; 60) verge one toward the other.
Figure 4B:
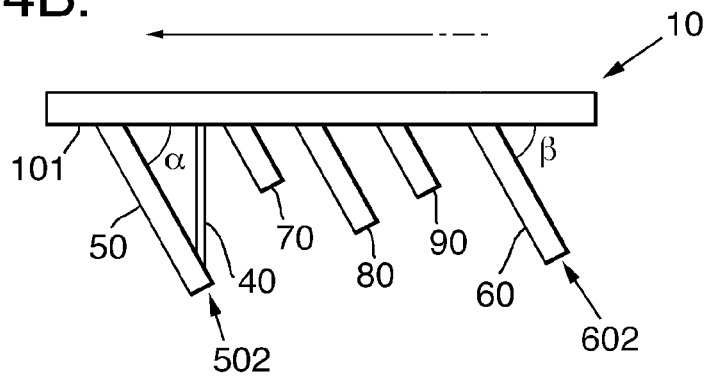
FIG. 4B shows an embodiment of the applicator according to the invention. A first and a second fin (50; 60) projects independently from the substantially flat internal surface (101) of the plate (10) and form independently with said substantially flat internal surface (10) substantially identical acute angles α and β. The distal edges (502; 602) of the first (50) and second (60) fin point toward the same direction without verging. Three additional fins (70; 80; 90) project independently one from the others and also independently from said first and second fin (50; 60). The single arrow on top of FIG. 4B indicates that the applicator (1) is unidirectional as discussed hereinafter. An embodiment of a supporting means is shown (40).

When the applicator (1) comprises a first and a second fin (50; 60) said distal edge (502) of said first fin (50) and distal edge (602) of said second fin (60) may verge one toward the other as shown in FIG. 1B, or may diverge toward opposite directions or they may point toward the same direction without verging as shown in FIG. 4B.

Preferably, said first and second fin (50; 60) project from said substantially flat internal surface (101) of said plate (10) such that said distal edges (502; 602) verge one toward the other as shown in FIG. 1B. Even more preferably, said first and second fin (50; 60) project independently from said substantially flat internal surface (101) of said plate (10) and form independently with said substantially flat internal surface (101) substantially identical acute angles α and β as shown in FIG. 1C. Even more preferably, said first and second fin (50; 60) extends independently for substantially identical average lengths (L1) and (L2) as shown in FIG. 1C.

When the applicator (1) according to the invention comprises only a first fin (50) as shown in FIG. 1A, or a first (50) and a second (60) fin which point toward the same direction as shown in FIG. 4B, then the applicator (1) is unidirectional. When the applicator (1) comprises a first (50) and a second (60) fin, whose distal edge (502; 602) verge one toward the other or diverge toward opposite directions, then the applicator (1) is bidirectional. The term "unidirectional" and "bidirectional" are explained in more detail in the method of use section hereinafter.

According to the present invention, one or more additional fins (70; 80; 90) may be present. Said one or more additional fins (70; 80; 90) independently project from said substantially flat internal surface (101) of said plate (10) as shown in FIGS. 4A and 4B.

Said first, (50) second (60) and said additional (70; 80; 90) fins may comprise a variety of materials and be manufactured independently of said applicator (1). Examples of materials useful for said first (50) and second (60) fins include, but are not limited to, a polymer resin such as a polyolefin e.g. polypropylene, polyethylene or polyethylene terephthalate. Other materials could be used including polyvinylchloride, polyamide, acetyl, acrylonitrile butadiene styrene, acrylic, acrylonitrile styrene acrylate, ethylene vinyl alcohol, polycarbonate, cellulose acetate, polychloropene, ethylene vinyl acetate, polychlorotrifluoroethylene, polyphenylene oxide, polysulfone, polyurethane, polytetrafluoroethylene, polyvinyl acetate or polystyrene, natural rubber, latex, nylon, nitrile, silicone polyurethane or thermo plastic elastomer or copolymers where appropriate or foams or a flexible pliable substrate such as paper, board, metal based substrates and aluminium foil, filmic substrates or multiple laminations or combinations of multiple layers of said materials. Preferably said first (50), second (60) and additional fins (70, 80, 90) are flexible.

In certain embodiments, both the said first fin and second fin (50; 60) and said plate (10) may be manufactured within the same injection or co-injection mould for example from polypropylene, acrylonitrile butadiene styrene, acrylic, acrylonitrile styrene acrylate, ethylene vinyl alcohol, polycarbonate, polystyrene, silicone or thermo plastic elastomer. The method of manufacture of said first fin and second fin (50; 60) may be independent from said application device (1). Useful manufacturing processes may include, but not limited to, injection moulding, co-injection moulding, over moulding, in-mold assembly, compression molding, blow moulding, thermo or vacuum forming. When the said first fin and said second fin (50; 60) as well as said additional fins (70; 80; 90) are independently manufactured from the application device (1), they may be attached by any suitable method to the internal surface (101) of said plates (10). Useful methods are, but not limited to, heat welding including pressure, ultrasonic forces, radio or high frequencies, co-extruded heat activated adhesives. Said first fin and said second fin (50; 60) may also be attached to the application device (1) through adhesive, including two-side tape, thermo-set, hot melt and cold seal, adhesion or extrusion lamination. Mechanical interlock or entanglement such as Velcro®, clamping, snap locks, sealing beads, locking pins and magnetism may also be used to adhere the said first fin and said second fin (50; 60) to the application device (1). Finally, said first and second fins (50; 60) may mechanically fit into slots cut through the plate (10) as described in the experimental data below.

One or more joining means (38) may be optionally provided to connect said first fin (50) to said second (60) fin as shown in FIG. 1B. Said one or more joining means (30) may also connect any of said one or more additional fins (70; 80; 90) to said first (50) and/or second (60) fin. A joining means (38) has a similar function as a rung on a ladder and it is preferably of minimal dimension so as to not provoke any displacement of hair treatment composition while the applicator is in use.

One or more supporting means (40) may be optionally provided to connect said first (50) and/or second (60) fin to said substantially flat internal surface (101) as shown in FIG. 4B. Said one or more supporting means (40) may also connect any one of said one or more additional fins (70; 80; 90) to said substantially flat internal surface (101) of said plate (10).

Suitable materials for manufacturing said joining means (38) and said supporting means (40) may be selected from those detailed above to manufacture said first fin (50).

3. Experimental Data

The present inventor has surprisingly found that to satisfactory apply a hair treatment composition to a hair strand, preferably to a bundle of hair strands, said hair strand needs firstly to come into contact with the hair treatment composition comprised within the applicator (1), secondly said hair treatment composition which just came into contact with said hair strand should be applied onto said hair strand and thirdly while using said applicator (1) along the entire length of said hair strand, the just applied hair treatment composition should not be removed from said hair strand.

Without wishing to be bound by theory, it is believed that to apply a hair treatment composition to a hair strand, preferably to a bundle of hair strands, said hair strand is located substantially straight between a containment portion (20) and a plate (10), which comprises a first fin (50), preferably a first (50) and second (60) fin, and then said hair strand is bent by said first fin (50), preferably said first (50) and second (60) fin, into said containment portion (20), where the hair treatment composition has been previously loaded. The bending of said hair strand within said containment portion (20), is primarily a function of the acute angle α and/or β and also of the fin lengths L1 and L2.

The present inventor has surprisingly found that to achieve a successful application of a hair treatment composition to a hair strand, preferably to a bundle of hair strands, acute angle α and/or β should independently be from about 25° to about 55°, preferably from about 35° to about 55°, more preferably from about 35° to about 50°. To demonstrate that an applicator (1) as described herein may provide an application of a hair treatment composition to a hair strand, preferably to a bundle of hair strands, it is shown herein how the average on-hair dosage and the average evenness change by changing acute angle α and/or β.

Figure 5B:
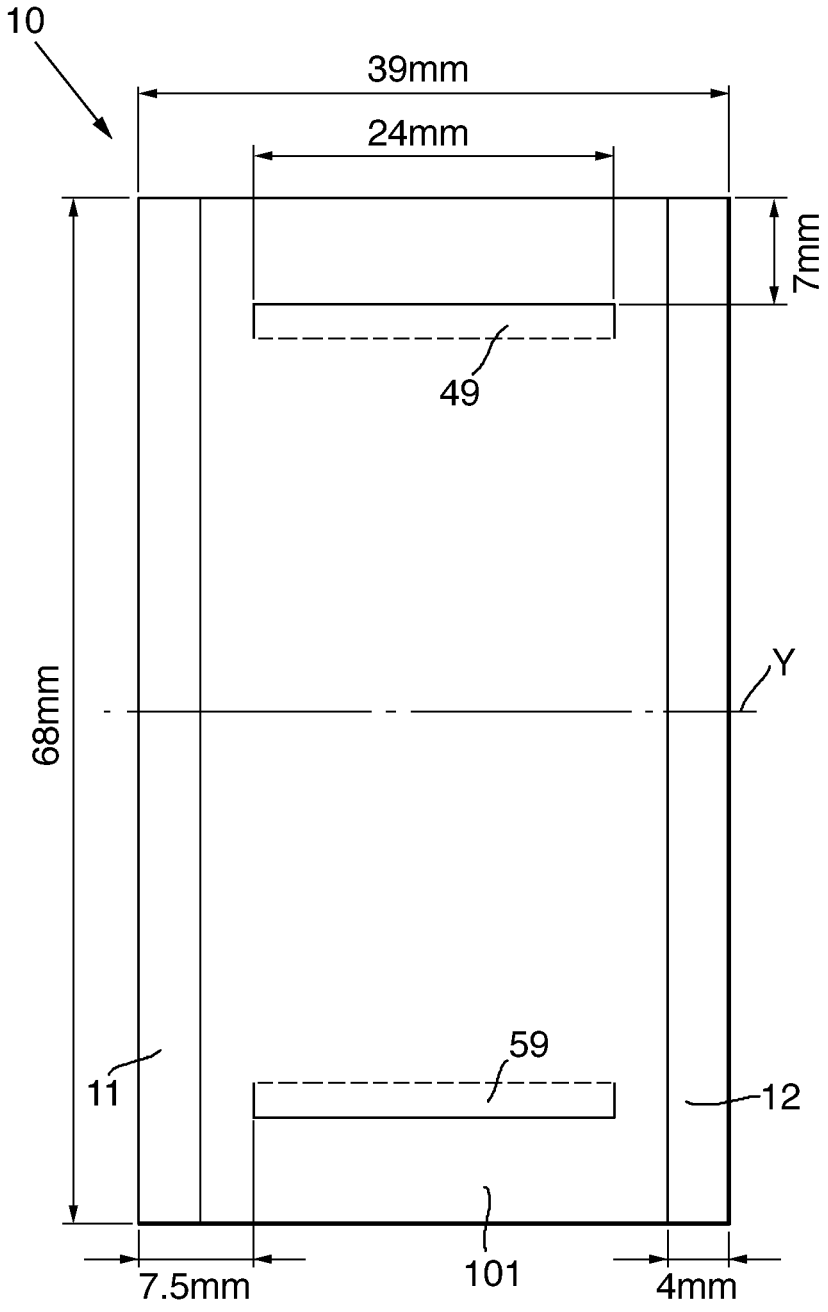
FIGS. 5B and 5D shows views of the substantially flat internal surface (101) of a plate (10) according to the invention. Axis Y is shown and crosses two strips (11; 12), positioned on the internal surface (101) of the plate (10) to function as a stop mechanism. Two slots (49; 59) are present through the plate (10).
Figure 5C:
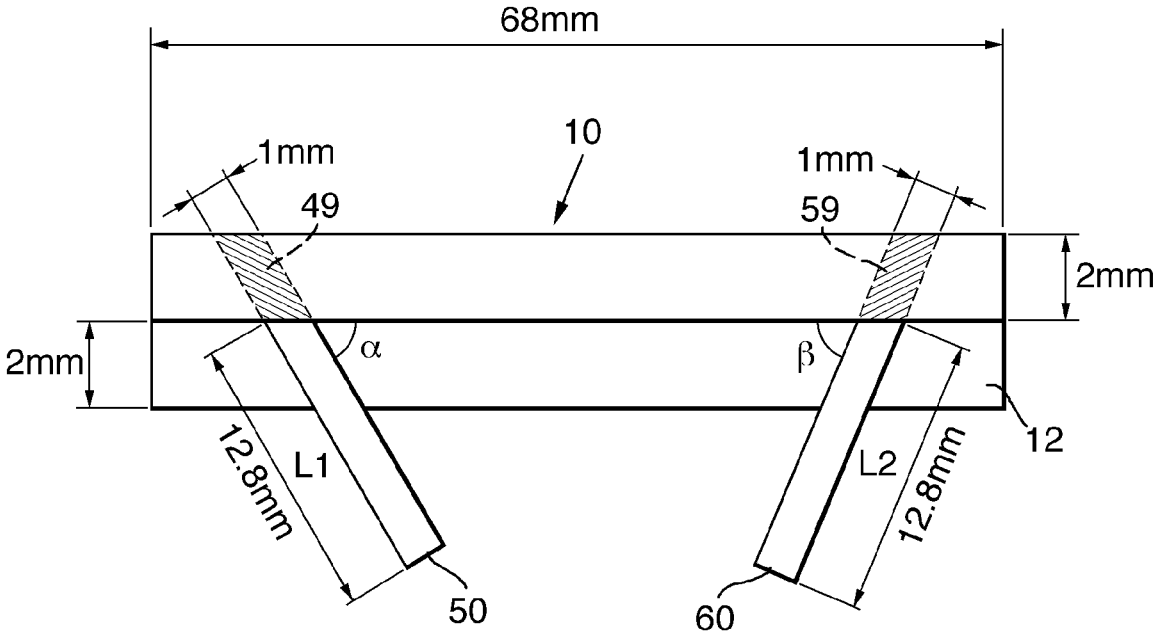
FIG. 5C shows a cross-section of the plate (10) of FIG. 5B taken along any of planes (P11 to P15) or on any planes parallel between those planes (P11 to P15). In this Fig. the first (50) and second (60) fins are shown slid into slots (49; 59) having a rectangular shape, substantially identical acute angles α and β and substantially identical first and second average lengths (L1; L2). One strip has been removed to show the first and second fin (50; 60), the other strip (12) is shown.

Rectangular plates (10) were manufactured in acrylic, having dimensions of about 68 mm in length, about 39 mm in width and about 2 mm in height as shown in FIGS. 5B and 5C. Two strips of acrylic (11; 12) having dimensions of about 68 mm in length, about 4 mm in width and about 2 mm in height were each fixed cold sealed along one of the 68 mm edge of said rectangular plates (10). The surface of said rectangular plates (10) where the strips were fixed cold sealed is the internal surface of said plate (10). Axis Y extends straight from the centre of said substantially flat internal surface of said rectangular plates (10) and crosses transversally both acrylic strips (11; 12).

Two slots (49; 59) were cut through said plates (10). Each of said slots (49; 59) measured about 24 mm in length and about 1 mm in width. Each of said slots was cut about 7 mm from each of the 39 mm edges and about 7.5 mm from each of the 68 mm edges of said flat internal surface (101). Said plates (10) were prepared with slots (49; 59) of different angles through said plate (10) to enable the orientation of a first and a second fin (50; 60) at certain angles α and β from said internal surface (101). A series of first and second fins (50; 60) were manufactured in MCP Silicon Rubber RTC-1604, said first and said second fins (50; 60) having substantially identical dimensions to provide average first and second lengths (L1; L2) as shown in tables 2, about 24 mm in average width (W1; W2) and about 1 mm in average thickness (T1; T2). Said first and said second fins (50; 60) were slid into said slots (49; 59) through said substantially flat internal surface (101) of said rectangular plates (10) as indicated in FIG. 5C. Said first fin (50) and said second fins (60) were slid into said slots (49; 59) so that each of said fins (50; 60) projected from said substantially flat internal surface (101) with an average first and second length (L1; L2). Said first (50) and second (60) fins were held in position by mechanical fit within said slots (49; 59). A constant average first and second height (H1; H2) were maintained for all the following experiments of about 6 mm.

Said two acrylic strips (11; 12) act as a stop mechanism and provide said average distance (D1) of said substantially flat internal surface (101) of said plate (10) as described above. Said first and second fins were placed into the slots described above located on the said plates (10) such that the lengths (L1, L2) of the fins projecting out of said substantially flat internal surface (101) of said plate (10) was such that the first and second height (H1, H2) was maintained for all angles α and β.

A rectangular portion (20) was made from acrylic. A base (201) and a wall (202) defined an internal volume (204) having an internal dimension of about 58 mm in length and about 29 mm in width and about 5 mm in height. The external dimensions of the containment portion (20) were about 68 mm in length and 39 mm in width. Said rim (222) of said wall (202) was of about 5 mm in width.

The plate (10) and the containment portion were kept apart and the containment portion (20) was loaded with about 2.0 grams of Carbopol™ 956 (available from Noveon) solution prepared according to table 1 below.

The viscosity of the Carbopol™ 956 solution was determined on a Brookfield DV-II+ viscometer with a S52 cone attachment. A sample of 0.5 ml of the Carbopol™ 956 solution was equilibrated at approximately 26.7° C. and 1 rpm for one minute prior to measurement, whereupon the average of three individual readings were taken at 1 rpm.

TABLE 1

Carbopol ™ 956 solution for measuring average on-hair dosage and average evenness

| Ingredients | % w/w |
|---|---|
| De-ionized Water | q.s. to 100 |
| Carbopol ™ 956 | 0.36 |
| Sodium Hydroxide (50% aq. Solution) | 0.27 |
| Ultramarine Blue pigment | 0.05 |
| Titanium dioxide | 0.41 |
| Average Viscosity | 36,600 cPs |

A 0.30 grams bundle of hair strands, about 30.5 cm long (Caucasian Light Brown—International Hair Imports and Products, Valhalla, N.Y.) was placed on the rim (222) of said square containment portion (20), so that when said substantially flat internal surface (101) of said square plate (10) is brought into a juxtaposed relationship to the opening of said square containment portion (20) said bundle of hair strand is perpendicular to said first (50) and second (60) fin and parallel to the strips acting as a stop mechanism. The plate (10) and containment portion (20) were brought into a juxtaposed relationship until the strips acting as a stop mechanism touched the rim (222) of the containment portion (20). As the substantially flat internal surface (101) of said plate (10) has the same extension of said opening (203) and rim (222) of said containment portion (20), the plate is laid upon the containment portion so that it completely and precisely covers said opening (203) and said rim (222). The bundle of hair strands is bent within said containment portion where the hair treatment composition has been loaded. While keeping the plate (10) and the containment portion (20) on the bundle of hair strands, the entire length of the bundle of hair strands was swiped taking about 3 seconds for the swipe. The weight of the bundle of hair strands was recorded. The same experiment was repeated three times, the results averaged and indicated in table 2 and in FIG. 6 as grams of pigmented Carbopol™ 956 solution deposited per gram of hair.

TABLE 2

Figure 6:
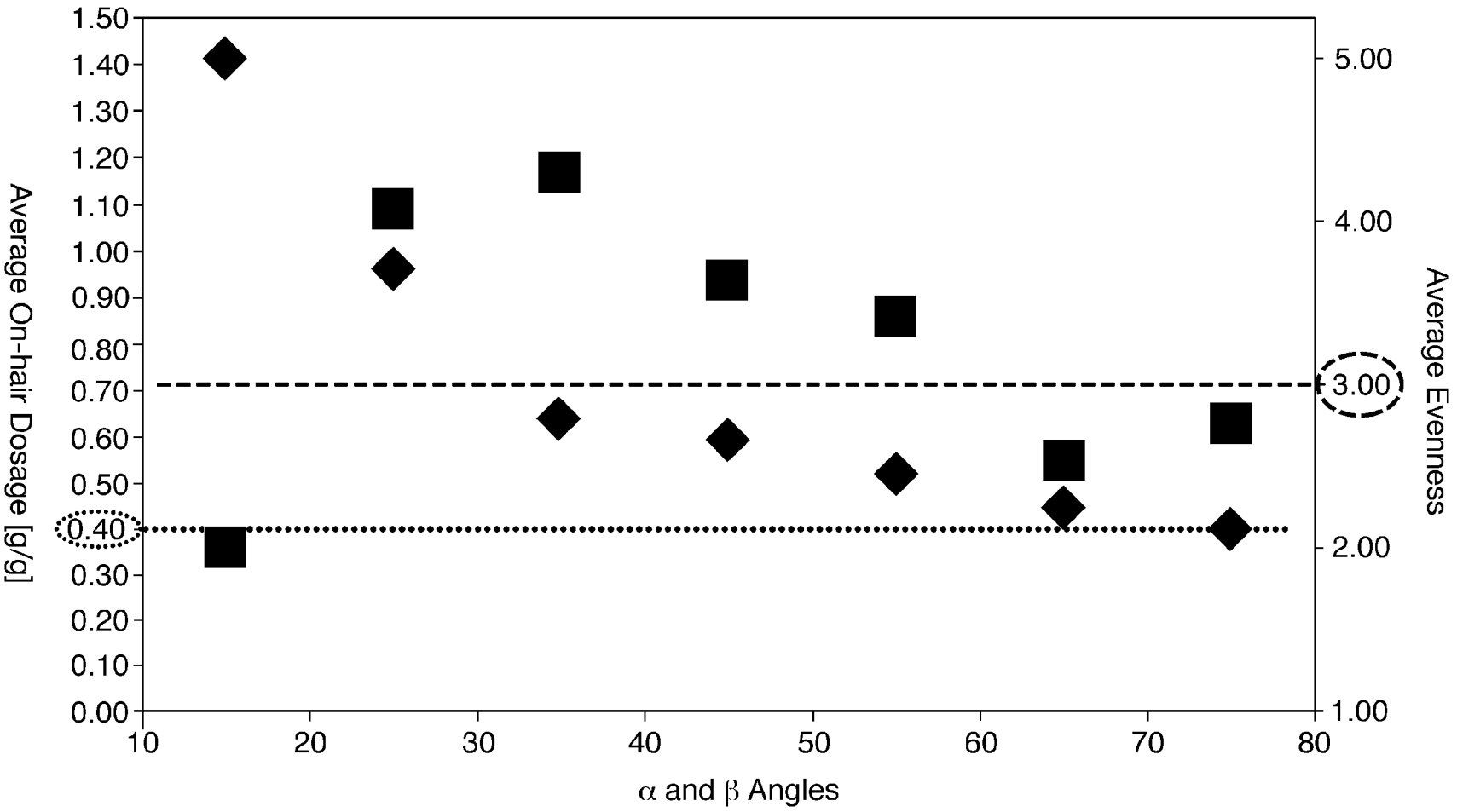
FIG. 6 shows for an embodiment of the hair treatment applicator (1) according to the invention how the average on hair dosage (♦) and the average evenness (■) change by changing acute angles α and β when a pigmented Carbopol™ 956 solution is applied to a bundle of hair strands.

Average on-hair dosage, average evenness data and relative acute angle α and β as shown in FIG. 6.

| Average lengths | | Angles | | Average | |
|---|---|---|---|---|---|
| L1 (mm) | L2 (mm) | α (degrees) | β (degrees) | on-hair dosage [g/g] | Average Evenness |
| 6.2 | 6.2 | 75 | 75 | 0.39 | 2.78 |
| 6.6 | 6.6 | 65 | 65 | 0.44 | 2.56 |
| 7.3 | 7.3 | 55 | 55 | 0.52 | 3.44 |
| 8.5 | 8.5 | 45 | 45 | 0.60 | 3.67 |
| 10.5 | 10.5 | 35 | 35 | 0.65 | 4.33 |
| 14.2 | 14.2 | 25 | 25 | 0.98 | 4.11 |
| 23.2 | 23.2 | 15 | 15 | 1.42 | 2.00 |

Said plate (10) was manufactured with different slots so that said first and second fin (50; 60) could be oriented from said internal surface (101) with different angles α and β. Said first average height (H1) of said first fin (50) and said second average height (H2) of said second fin (60) were chosen to be about 6 mm to ensure that said hair strand is bent within said Carbopol™ 956 solution contained in said containment portion (20).

The evenness of the application was visually assessed for root-to-tip (along length of hair bundle); center-to-edge (across hair bundle width) and front-to-back (both sides of hair bundle) using a 1 to 5 rating scale (1 being poor evenness). These ratings were combined to provide an average evenness, which is shown in table 2.

FIG. 6 shows the average on-hair dosage in grams of pigmented Carbopol™ 956 solution deposited per gram of hair (shown with the symbol ♦) and the average evenness (shown with the symbol ■) as a function of acute angles α and β. A successful hair treatment application has been defined from the present inventor as to be the combination of an average evenness of at least about 3 and an average on-hair dosage of at least about 0.4 grams of pigmented Carbopol™ 956 solution per gram of hair.

When acute angles α and β are less than about 25°, although the average on-hair dosage is above about 0.4 grams of pigmented Carbopol™ 956 solution per gram of hair, the average evenness is below about 3. Thus, if the bundle of hair strands is bent with a first (50) and a second (60) fin forming with said substantially flat internal surface (101) acute angles α and β of less than about 25°, the application of a hair treatment composition to a bundle of hair strands is poor and not satisfactory.

When acute angles α and β are from about 25° to about 55°, the application of the pigmented Carbopol™ 956 solution to a bundle of hair strands is satisfactory as both the average on-hair dosage and the average evenness are above the limits defined herein, thus, providing for the best combination.

When the acute angles α and β are more than about 55°, the average on-hair dosage decreases below about 0.4 grams of pigmented Carbopol™ 956 solution per gram of hair. In addition, for acute angles α and β of more than about 65°, the average evenness is below about 3. Thus the application becomes poor and not satisfactory.

Figure 5D:
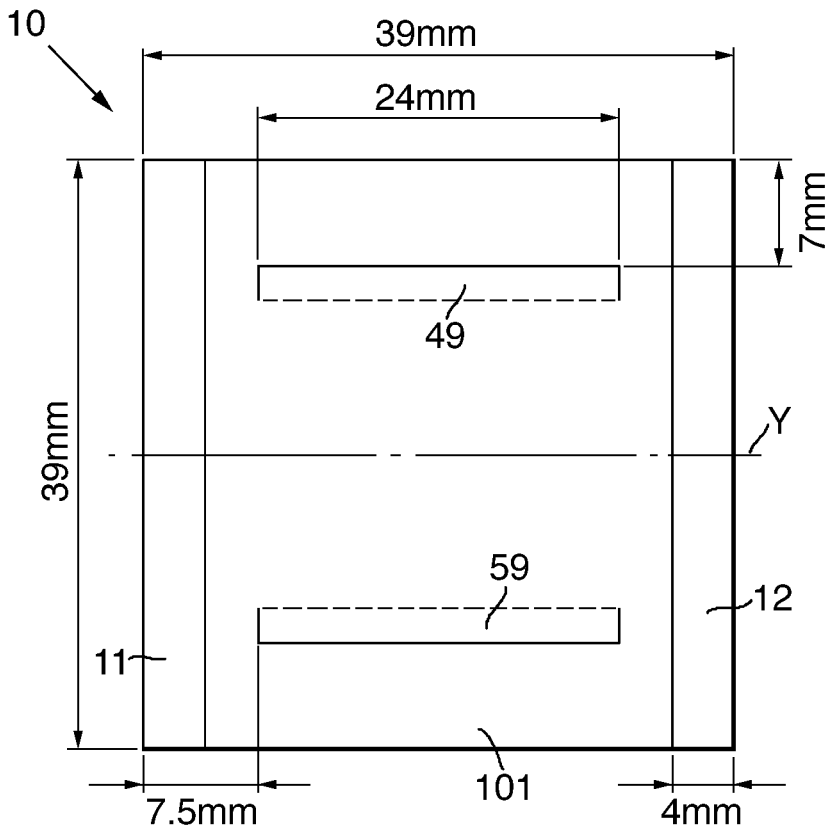

A series of second square plates (10) was manufactured according to the dimensions above in this example the length of said plates (10) and identical strips (11 and 12) were about 39 mm as shown in FIG. 5D. A second containment portion (20) was also produced according to the internal dimensions above with the exception that the internal length of said plate (10) was about 29 mm and the external length of said plate (10) was about 39 mm. Said rim (222) of said wall (202) was of about 5 mm in width. Said second plates (10) and said second containment portion (20) were aligned such that the 39 mm length of said second plate (10) was aligned with the 39 mm length of said second containment portion (20) and kept apart.

The experiment was repeated with the said second applicators (1) as shown in FIG. 5D, with the same type of hair and with the same method as described hereinabove, but in this example the second containment portion (20) was loaded with about 2.00 grams of the highlighting composition prepared according to table 3 below instead of the pigmented Carbopol™ 956 solution:

TABLE 3

| Highlighting composition | % |
|---|---|
| Developer | |
| Deionized Water | 72.35 |
| Hydrogen Peroxide 50% | 18.00 |
| Cetearyl Alcohol (and) Ceteareth-20 | 1.50 |
| Glyceryl Stearate | 4.00 |
| Oleth-10 | 0.30 |
| Oleth-2 | 0.30 |
| Stearamidopropyl Dimethylamine | 0.60 |
| Etidronic Acid | 0.25 |
| Persulfate Powder | |
| Potassium Persulfate (+silica) | 45.0 |
| Ammonium Persulfate (+ silica) | 10.0 |
| Sodium Silicate | 39.5 |
| Disodium EDTA | 1.0 |
| TiO2 | 3.5 |
| UM Blue | 1.0 |

The highlighting composition was prepared by mixing about 9.71 grams of persulfate powder with about 35.00 grams of developer in a bottle of about 100 ml. Mixing was performed by hand-shaking the bottle for about 30 seconds.

Average on-hair dosage and average evenness are shown in table 4 below and are plotted in FIG. 7.

TABLE 4

Average on-hair dosage, average evenness data, first and second average lengths (L1; L2) and relative acute angles α and β as shown in FIG. 7.

| Average lengths | | Angles | | Average | |
|---|---|---|---|---|---|
| L1 (mm) | L2 (mm) | α (degrees) | β (degrees) | on-hair dosage [g/g] | Average Evenness |
| 6.2 | 6.2 | 75 | 75 | 0.28 | 2.78 |
| 6.6 | 6.6 | 65 | 65 | 0.32 | 3.56 |
| 7.3 | 7.3 | 55 | 55 | 0.68 | 4.11 |
| 8.5 | 8.5 | 45 | 45 | 0.85 | 4.22 |
| 10.5 | 10.5 | 35 | 35 | 0.71 | 4.33 |
| 14.2 | 14.2 | 25 | 25 | 0.95 | 4.11 |

The highlighting product was left on the bundle of hair strands for about 30 minutes at about 30° C. and rinsed with water for one minute and air dried for 24 hours. The bundle of hair strands treated with applicators that provided an angle between 55 and 25 degrees were observed to have changed to a uniform lighter color. Those treated with fin angles of 65 and 75 degrees were both darker in color, and the color changes were less uniform.

Figure 7:
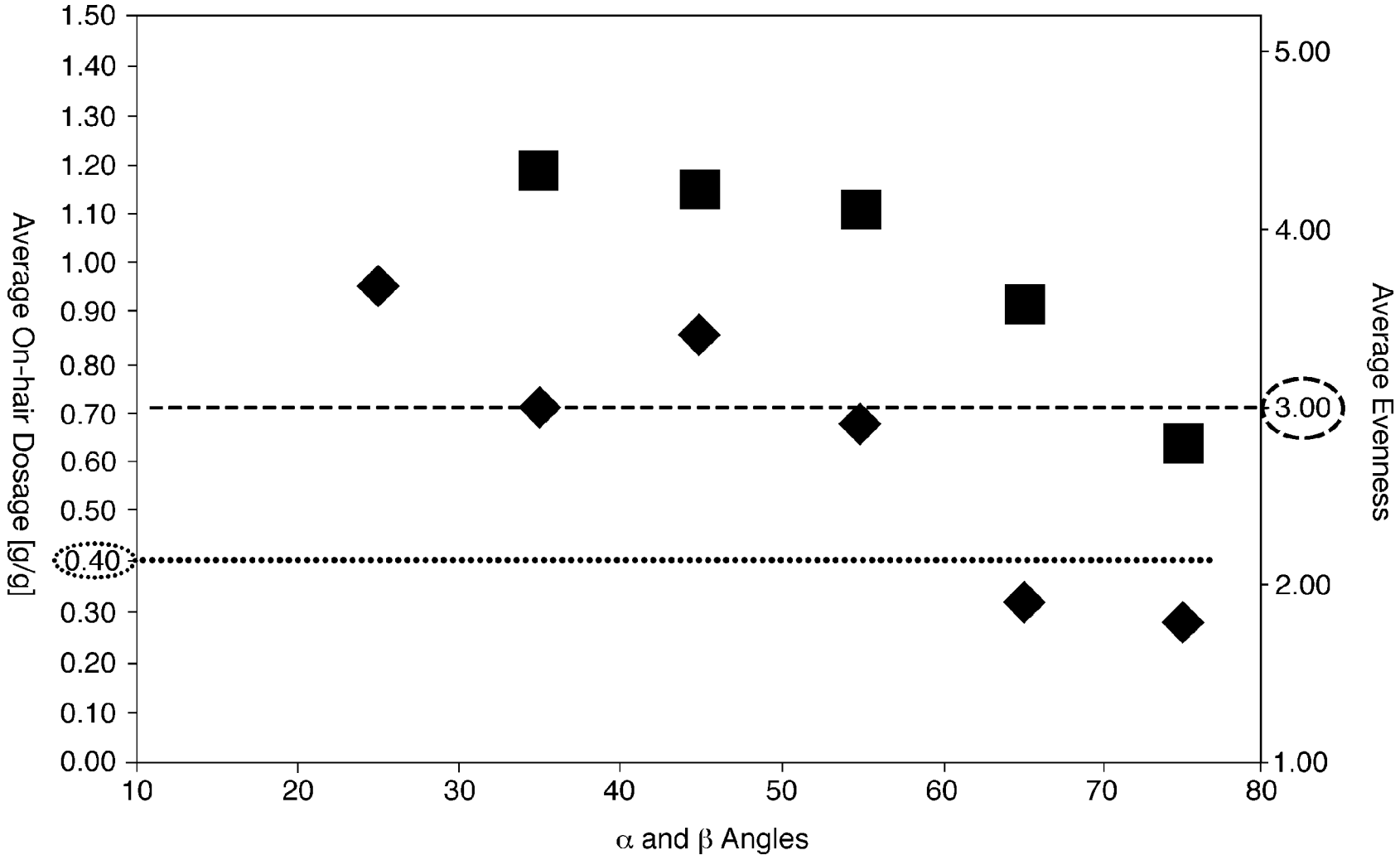
FIG. 7 shows for an embodiment of the hair treatment applicator (1) according to the invention how the average on hair dosage (♦) and the average evenness (■) change by changing acute angles α and β when a highlighting composition is applied to a bundle of hair strands.

FIG. 7 shows a similar trend for the average on-hair dosage and the average evenness as for the pigmented Carbopol™ 956 solution. When the acute angles α and β is above about 55°, although the average on-hair dosage is just about 0.5 grams of highlighting composition per gram of hair, the average evenness is below about 3.0. Thus, according to the present invention, the application is poor and not successful. For acute angles α and β of from about 25° and above till about 55° as already shown for the pigmented Carbopol™ 956 solution, the application of the highlighting composition is considered to be satisfactory.

To summarize, firstly acute angles α and/or β as defined herein correlates with the average on-hair dosage and the average evenness, secondly only a specific range of acute angles α and/or β values provide for an satisfactory result and thirdly said range of acute angles α and/or β values are independent of the type of hair treatment composition applied.

4. Additional Features

The applicator (1) may further comprise one or more sealing means, preferably one sealing means (401) is present within the hair treatment applicator (1). Said sealing means (401) may be located within said containment portion (20) on said bottom (201) at the wall (202) adjacent to said connection (30). Said sealing means (401) may be located on said rim (222) of said wall (202) adjacent to said connection (30) as shown in FIG. 2 or on said substantially flat internal surface (101) adjacent to said connection (30). Preferably said sealing means (401) is part of said connection (30).

The sealing means (401) is provided to avoid displacement of the hair treatment composition towards the connection (30) and hair from being trapped within said connection (30) when said substantially flat internal surface (101) of said plate (10) is brought into a juxtaposed relationship to said opening (203) of said containment portion (20). When the plate (10) is moved toward the containment portion (20) by pivoting about the connection (30) the hair treatment composition may be displaced toward the connection (30) itself; by having a sealing means (401) adjacent to said connection (30) the displacement may be avoided. The sealing means (401) acts as a barrier for the hair treatment composition, which is instead forced to stay within said containment portion (20) where it will be available for coating the hair strands avoiding messiness.

An additional advantage related to certain embodiments of said sealing means (401) comprises a visual aid to help the user to understand where and how much hair treatment composition should be loaded within the internal volume (204) of said containment portion (20).

Useful materials to manufacture a sealing means (401) may be selected from those detailed herein above to manufacture said plate (10). Other materials which may also be used include polyurethane and polyolefin foams, non-wovens, felts, where appropriate; flexible pliable substrates such as paper boards, metal based substrates and aluminium foils, filmic substrates or multiple laminations or combinations of multiple layers of said materials. The said sealing means (401) may be manufactured by a combination of the materials described above.

One or more stop mechanisms may be incorporated onto said hair treatment applicator (1). The stop mechanism collaborates with said connection (30) to ensure that when said substantially flat internal surface (101) of said plate (10) is brought into a juxtaposed relationship to said opening (203) of said containment portion (20), the average distance (D1) between the substantially flat internal surface (101) and said rim (222) is controlled. One or more stop mechanism may reduce forcing the hair treatment composition beyond said rim (222) of said containment portion (20).

In certain embodiments, the stop mechanism may be manufactured during the same manufacturing step as said plate (10), said containment portion (20) and said connection (30) with the same or different material. In certain embodiments the stop mechanism may be one or more tines, teeth of a comb-like structure. In one embodiment as shown in FIG. 2, two stop mechanisms are comprised on said rim (222) of said wall (201) of said containment portion (20), preferably said two stoppers are two substantially identical hemispheres (402; 403). In another embodiment as shown in FIGS. 5C and 5D, said stop mechanism may comprise two strips of material (11; 12), preferably of the same material used to manufacture said plate (10), said strips (11; 12) being positioned at the perimeter (103) of said plate (10). In certain other embodiments, not shown herein, the stop mechanism may be integrated within the connection (30) itself.

Useful materials to manufacture a stop mechanism (402) may be selected, where appropriate, from those detailed herein above to manufacture said plate (10) and combinations thereof.

Fingers may be used to select the hair strands on which the hair treatment composition should be applied. The applicator (1) of the present invention may however be further provided with hair strand selection means. Examples of hair strand selection means are, but not limited to, spikes, hooks, crochets, clips or beads. The hair strand selection means may be incorporated onto said plate (10) and/or said containment portion (20). Said means may also be attached through a snap mechanism to said plate (10) and/or said containment portion (20) such that the hair strand selection means may swing from a position proximal to said plate (10) and/or said containment portion (20) to a far one, such as it happens with the blades of a penknife. The hair strand selection means may also be separately provided to the applicator (1) of the present invention as a component of a kit as described herein below.

The applicator (1) disclosed herein may further comprise gripping areas on the external surfaces (102) of said plate (10) and/or on said base (201) of said containment portion (20). Said gripping areas are designed to provide grip. These gripping areas may be manufactured using co-injection or overmoulding techniques when the hair treatment applicator is manufactured. Useful materials include, but are not limited to, those materials detailed herein above for the manufacture of said sealing means (401) and combinations thereof.

In addition, the gripping areas may be formed through embossing, debossing or coating of the external surfaces (102) of said plate (10) and/or of said base (201) of said containment portion (20). Gripping means may be cavities present on the external surface (102) of said plate (10) and/or on said base (201) of said containment portion (20). Finally, the gripping means may be provided as fastening means to accommodate the user's fingers.

To protect said substantially flat internal surface (101) of said plate (10) and/or the opening (203) of said containment portion (20) release liners or barriers may be present. The release liner or barrier may be peelable or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

One or more means suitable to attach, adapt or install a dispensing or loading device to perform the loading of the hair treatment composition into the applicator (1) according to the invention may be present. Examples of said means are, but not limited to, nozzles and orifices, pouch pocket or one-way or two-way valves present on said plate (10) and/or said base (201) and/or wall (202) of said containment portion (20). Said means may be permanently connected to the applicator (1) or may be removable, they may be disposable or recyclable and they may be provided as a separate component of a kit as described herein below.

4. Method of Use

The present invention also relates to a method to treat the hair by contacting a hair strand, preferably a bundle of hair strands, with said applicator (1) according to the invention. Said applicator (1) may be pre-loaded with one or more hair treatment compositions, but preferably one or more hair treatment compositions are loaded into said applicator (1) before contacting said hair strand, preferably said bundle of hair strands, with said applicator (1).

The hair treatment composition can be loaded onto said applicator (1) by any means. In one embodiment the hair treatment composition is loaded directly into said internal volume (204) of said containment portion (20) by applying the hair treatment composition for example with a spatula or a syringe, by a squeezable tube, by a dispensing bottle, by a single or dual phase pump, by a single or dual phase piston causing volumetric displacement, by a sachet or by any other suitable dispenser. When an optional means to perform the loading of the hair treatment composition into said applicator (1) as described above is present, the hair treatment composition may be loaded into said containment portion (20) through a one-way or two-way valve present in said means and/or in said wall (202) or bottom (201) of said containment portion (20).

The hair treatment compositions may be formed by a first hair treatment composition which requires mixing with a second hair treatment composition before application to the hair. Preferably, said first and second hair treatment compositions are mixed to form a third hair treatment composition. Said third hair treatment composition is loaded in said applicator (1) before contacting the hair with said applicator (1). Said first and second hair treatment composition may be mixed by shaking or stirring before loading into said applicator (1) or may be mixed during the loading procedure by employing specialized two or multi-chambered containers coupled with a static mixer. The mixing may also be performed by interposing an additional means capable of mixing two or more hair treatment compositions or capable of mixing powders with water or other solvents to make a hair treatment composition. Said interposed means can also be provided with features to inject or load the mixed hair treatment compositions into said applicator (1).

Multiple or subsequent loading may be accomplished by positioning, said applicator (1) in a tray or by connecting or attaching said applicator (1) to multi-chambered bottles, tubes or other applicators capable of dispensing either the single or the total amount of the hair treatment composition needed. When a tray is used, said tray comprises at least one compartment where said applicators (1) are positioned or adapted. The tray may further comprise one or more compartments where the hair treatments compositions are loaded and/or stored and which are in communication with the hair treatment applicator (1).

The amount of hair treatment composition loaded on said applicator (1) depends upon its size and capacity and the desired end results. Said applicator (1) may be preferably loaded with an amount of hair treatment composition from about 0.5 gram to about 20 grams, more preferably from about 0.75 gram to about 17 grams, even more preferably from about 1 gram to about 10 grams of hair treatment composition.

Once said applicator (1) is loaded with one or more hair treatment compositions, the user holds through the external surfaces (102) of said plate (10) and bottom (201) of said containment portion (20) said applicator (1) in one hand, preferably between the thumb and the index finger. Once the user has selected the hair strands to be treated, said hair strand, preferably said bundle of hair strands, is positioned substantially straight between said plate (10) and said containment portion (20) while the applicator (1) is in an open state. Subsequently said applicator (1) is brought into a closed state. While kept in a closed state the hair treatment applicator (1) is swiped along the length of said hair strand, preferably of said bundle of hair strands to apply said one or more hair treatment composition. More preferably said applicator (1) is located at the root-line of said hair strand, preferably at the root-line of said bundle of hair strands. The hair treatment composition may also be applied only to limited areas of the hair, i.e. the user can coat only the root-line with the hair treatment composition. The swiping may be repeated more than once, preferably twice.

The applicator (1) according to the invention may be "unidirectional" or "bidirectional". The terms unidirectional and bidirectional are relative to the method of use of the applicator (1) according to the invention. When only a first fin (50) is present, the applicator (1) should be positioned at the root-line of a hair strand, preferably at the root-line of a bundle of hair strands, so that said hair strand is perpendicular to said distal edge (502) of said first fin (50) and acute angle $\alpha$, which is formed by said first fin (50) with said substantially flat internal surface (101) said plate (10) should face the tip of said hair strand.

When a first (50) and a second (60) fin are present, it depends whether said distal edges (502; 602) of said first (50) and second (60) fin verge one toward the other, point both toward the same direction or each points toward opposite direction. If said distal edges (502; 602) point both toward the same direction then the applicator (1) should be used as if only a first fin (50) was present and the acute angle $\alpha$ or $\beta$ should be facing the tip of said hair strand.

If said distal edges (502; 602) point toward opposite directions or preferably verge one toward the other than the applicator (1) may be used by placing either acute angle $\alpha$ or acute angle $\beta$ facing the tip of said hair strand.

In certain embodiments a first hair treatment composition is applied to the hair via any of the known conventional methods as a pre- or post-treatment, a second hair treatment composition can then be applied via said applicator (1) according to the present invention. For example the first hair treatment composition is a dyeing composition to perform a full head colouration and the second hair treatment composition is a highlighting composition used to add variation in colour to the full head coloration. Alternatively a different dyeing composition could be used after the full head colouration to add variation in hair colour. Those skilled in the art would understand that many such combinations of hair treatment compositions may be used to create different results.

Finally, the application of the hair treatment composition may occur on wet or dry hair and optionally, a rinsing or a shampooing step can be included between application of the first and second compositions to the hair.

5. Hair Treatment Compositions, Use Thereof and Kit.

Examples of hair treatment compositions that may be applied via said applicator (1) according to present invention are discussed below. Preferably, these compositions are selected from the group consisting of styling compositions, dyeing compositions, highlighting compositions or combinations thereof. Each of these hair treatment compositions or combinations thereof may be used to provide a hair strand effect with said applicator (1) described above. More preferably, the present invention relates to the use of a highlighting composition to highlight a hair strand, preferably a bundle of hair strands, with an applicator (1) as claimed herein. Said highlighting composition, preferably, comprises a rheology of from about 10 Pa to about 160 Pa, more preferably of from about 12 Pa to about 120 Pa, most preferably from 15 Pa to 80 Pa at 1.0 $s^{-1}$.

The rheology of the hair treatment composition is measured using a TA Instruments Advanced Rheometer (AR) 2000. The instrument is provided with a concentric cylinder base with an internal radius of 15.00 mm and standard size vane geometry with a radius of 14.00 mm and a height of 42.00 mm. The geometry gap is set at 4000 microns. Hair treatment compositions which are made up of more than one formulations are prepared by mixing those various formulations thoroughly by hand shaking in a sample pot for 30 seconds. The mixed hair treatment composition is then placed immediately into the concentric cylinder base, and the standard vane geometry is lowered to the geometry gap such that the top of the vanes are covered by the hair treatment compositions. The temperature is equilibrated to 25° C., and then hair treatment composition is left for an additional 30 seconds before the shear rate increases logarithmically from about 0.05 to about 200 $s^{-1}$, recording seven points per decade. At all stages the temperature is maintained at 25° C. The shear stress is recorded at 1.0 $s^{-1}$ and reported in Pa.

Examples of hair treatment compositions which can be used with said applicator (1) according to the invention are indicated below in tables 5, 6 and 7.

The hair treatment compositions may comprise components known, conventionally used, or otherwise effective for use in hair treatment compositions particularly oxidative bleaching and dye compositions which include but are not limited to: developer dye compounds; coupler dye compounds; direct dyes; D&C Orange 4, Acid Yellow 1, D&C Red No. 28, Disperse Red 17, HC Blue No. 15, Acid Blue, oxidizing agents; reducing agents; thickeners; chelants; amodimethicone; ethylenediamine disuccinic acid; pH modifiers and buffering agents; alkalising agents, carbonate ion sources and radical scavenger systems; glycine; anionic, cationic, non-ionic, amphoteric or zwitterionic surfactants, or mixtures thereof; anionic, cationic, non-ionic, amphoteric or zwitterionic polymers, hydrophobically modified polymers or mixtures thereof; fragrances; dispersing agents; solvents, peroxide stabilizing agents; chelants, humectants, proteins and derivatives thereof, plant materials (e.g. aloe, chamomile and henna extracts); silicones (volatile or non-volatile, modified or non-modified), film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) are useful in identifying specific adjuvants to achieve a particular purpose or multipurposes. A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

The present invention further comprises a kit. Said kit comprises one or more applicators (1) as described above and one or more individually packaged hair treatment compositions.

In one embodiment of the present invention, said one or more individually packaged hair treatment compositions comprise a first individually packaged hair treatment composition and a second individually packaged hair treatment composition. When mixed said first and second individually packaged hair treatment compositions form a third hair treatment composition. Examples of such compositions include so called semi-permanent and permanent colorants which typically contain oxidative dyes and an oxidant, and highlighting compositions containing an oxidant and an alkalising agent, optionally with a persulfate salt. Preferably, said first individually packaged composition comprises an oxidizing agent and said second individually packaged composition comprises an alkalizing agent. Preferably, said oxidizing agent is hydrogen peroxide. More preferably, at least one of said first and/or second individually packaged hair treatment composition comprises a persulfate salt.

In one embodiment of the kit according to the present invention said first individually packaged hair treatment composition comprises from 3% to 12% of hydrogen peroxide by weight of said first individually packaged hair treatment composition and said second individually packaged hair treatment composition is in the form of a powder or paste and said second individually packaged hair treatment composition comprises from 10% to 60% of persulfate salt selected from sodium persulfate, potassium persulfate, ammonium persulfate or mixtures thereof, by weight of said second individually packaged hair treatment composition. Said kit optionally comprises a third individually packaged hair treatment composition comprising from 3% to 25% of an alkalizing agent in an aqueous vehicle, by weight of said third individually packaged hair treatment composition.

In another embodiment of the present invention said first individually packaged hair treatment composition comprises from 1.5% to 12% of hydrogen peroxide by weight of said first individually packaged hair treatment composition and said second individually packaged hair treatment composition comprises from 0.01% to 6% of a dye selected from direct dyes, oxidative dye precursors, oxidative dye couplers or mixtures thereof, by weight of said second individually packaged hair treatment composition.

Additional individually packaged hair treatment compositions may be present in the kit-of-part and may comprise components such as shampoo, conditioner and styling products.

Herein below in are given some examples of hair treatment compositions which may be loaded into said applicator (1) according to the invention.

A hair bleaching composition was prepared by mixing about 45 g of any of the formulations of Phase 1 (1.1, 2.1, 3.1, 4.1, 5.1, 6.1, 7.1, 8.1 or 9.1, table 5), which were in a liquid form with about 15 g of any of the formulations of Phase 2 (1.2, 2.2, 3.2, 4.2, 5.2, 6.2, 7.2, 8.2 or 9.2 in table 5), which were in a powder form. Mixing was achieved as follow: the powder formulation of Phase 2 was placed into a mixing tray and the liquid formulation of Phase 1 was poured on top of the powder. The two formulations were then mixed together using a spatula to form a bleaching composition. Mixing was completed when the bleaching composition looked visually homogeneous.

TABLE 5

Formulations of Phase 1 and 2 which can be mixed to form a highlighting composition. All ingredients are in percentage by weight of the formulation phase.

| Phase 1 | 1.1 | 2.1 | 3.1 | 4.1 | 5.1 | 6.1 | 7.1 | 8.1 | 9.1 |
|---|---|---|---|---|---|---|---|---|---|
| De-ionized Water | q.s. to 100% | q.s. to 100% | q.s. to 100% | q.s. to 100% | q.s. to 100% | q.s. to 100% | q.s. to 100% | q.s. to 100% | q.s. to 100% |
| Glycerine | 5.00 | | | | | | | | |
| Hydrogen Peroxide (35% Active) | 17.20 | 17.20 | 17.20 | 17.20 | 17.20 | 17.20 | 17.20 | 17.20 | 17.20 |
| Disodium EDTA | 0.04 | 0.04 | 0.04 | 0.04 | 0.04 | 0.04 | 0.04 | 0.04 | 0.04 |
| Carbopol ™ 956 [1] | 1.00 | | | | | | | | |
| Sodium Hydroxide (50% aq. Solution) | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 | q.s. to pH 3.5 |
| Keltrol ™ T [2] | | | 1.25 | | | | | | |
| Stearyl Alcohol [3] | | 2.00 | | 1.00 | 1.00 | 2.00 | 2.00 | 2.00 | 2.00 |
| Cetyl Alcohol [4] | | 3.00 | | 1.50 | 1.50 | 3.00 | 3.00 | 3.00 | 3.00 |
| Ceteareth 25 [5] | | 1.50 | | 0.75 | 0.75 | 1.50 | 1.50 | 1.50 | 1.50 |
| Aculyn ™ 33 [6] | | | | 2.40 | | | | | |
| Natrosol ™ Plus CS Grade 330 [7] | | | | | 1.25 | | | | |
| Salcare ™ SC 90 [8] | | | | | | | 1.00 | | |
| **Phase 2** | **1.2** | **2.2** | **3.2** | **4.2** | **5.2** | **6.2** | **7.2** | **8.2** | **9.2** |
| Persulfate Powders | | | | | | | | | |
| Ammonium Persulfate | 28.60 | 28.60 | 28.60 | 28.60 | 28.60 | 28.60 | 28.60 | 28.60 | 28.60 |
| Potassium Persulfate | 50.00 | 50.00 | 50.00 | 50.00 | 50.00 | 50.00 | 50.00 | 46.00 | 47.00 |
| Sodium Persulfate | 7.14 | 7.14 | 7.14 | 7.14 | 7.14 | 7.14 | 7.14 | 7.14 | 7.14 |
| Sodium Metasilicate | 14.26 | 14.26 | 14.26 | 14.26 | 14.26 | 14.26 | 14.26 | 14.26 | 14.26 |
| Keltrol T (Xanthan Gum) | | | | | | | | 4.00 | |
| Carbopol ™ Ultrez 10 [9] | | | | | | | | | 3.00 |

[1] Carbopol ™ 956, Noveon Inc.
[2] Keltrol ™ T-CP Kelco
[3] Stearyl Alcohol Crodacol S-95, Croda, Inc.
[4] Cetyl Alcohol, Crodacol C-70, Croda, Inc.
[5] Ceteareth 25, Cremophor A 25, BASF Corporation
[6] Aculyn ™ 33, Rohm and Hass Company Inc.
[7] Natrosol ™ Plus CS Grade 330, Hercules Incorporated
[8] Salcare ™ SC 90 Ciba Specialty Chemicals Corporation
[9] Carbopol ™ Ultrez 10

In another example a bleaching composition was prepared by mixing into a tray with a spatula 30 g of component (a1), in table 6, comprising hydrogen peroxide with 15 g of component (b1), in table 6, comprising persulfate salts. In another example a bleaching composition was prepared as follows: 10 g of component (b2), in table 6, comprising persulfate salts in a powder form were added into a bottle of about 160 ml which already contained about 60 g of component (a2), in table 6. Finally, about 20 g of component (c2), in table 6, comprising ethanolamine, was added to the bottle. The bottle was closed with a cap provided with a nozzle. Mixing was achieved by hand shaking the bottle with the three components till a homogeneous hair bleaching composition was formed.

TABLE 6

Formulations of components (a1), (a2), (b1), (b2) and (c2) which can be mixed to form a highlighting composition. All ingredients are indicated in grams.

| Ingredients | (a1) | (a2) |
|---|---|---|
| Water | 78.54 | 67.34 |
| Hydrogen peroxide (35% active) | 17.14 | 25.71 |
| Cetearyl alcohol [10] | 2.25 | |
| trideceth 2 carboxamide MEA [11] | 0.85 | |
| ceteareth-30 [12] | 0.60 | |
| glycerin | 0.50 | |
| pentasodium pentetate [13] | 0.06 | |
| sodium stannate | 0.04 | |
| tetrasodium pyrophosphate | 0.02 | |

TABLE 6-continued

Formulations of components (a1), (a2), (b1), (b2) and (c2) which can be mixed to form a highlighting composition. All ingredients are indicated in grams.

| | | |
|---|---|---|
| Cetearyl Alcohol (and) Ceteareth-20 [14] | | 1.50 |
| Glyceryl Stearate [15] | | 4.00 |
| Oleth-10 [16] | | 0.30 |
| Oleth-2 [17] | | 0.30 |
| Stearamidopropyl Dimethylamine[18] | | 0.60 |
| Etidronic Acid | | 0.25 |
| **Ingredients** | **(b1)** | **(b2)** |
| potassium persulfate | 42.80 | 35.00 |
| sodium silicate | 22.50 | 35.00 |
| sodium persulfate | 11.00 | |
| Ammonium persulfate | | 27.50 |
| acrylates/C10-30 alkyl acrylate crosspolymer [19] | 4.30 | |
| urea | 3.00 | |
| Kaolin | 2.90 | |
| Magnesium Stearate [20] | 2.80 | |
| Ammonium Chloride | 2.60 | |
| diethylhexyl sodium sulfosuccinate [21] | 2.00 | |
| VP/VA copolymer [22] | 2.00 | |
| Polydecene [23] | 1.70 | |
| Sodium lauryl sulfate [24] | | 1.50 |
| sodium metasilicate | 1.60 | |
| EDTA | 0.80 | 1.00 |
| **Ingredients** | | **(c2)** |
| Water | | 56.30 |
| Ethanolamine | | 15.00 |
| Cetearyl alcohol/hydroxyethyl behenamidopropyl dimonium chloride/hexylene glycol [25] | | 2.50 |
| Cocamide MEA [26] | | 12.00 |
| Dilinoleic acid [27] | | 4.00 |
| Disodium wheatgermamphodiacetate [28] | | 3.00 |
| Linoleamidopropyl dimethylamine dimer dilinoleate [29] | | 2.00 |
| Stearamide MEA [30] | | 4.00 |
| Sodium sulfite | | 0.50 |
| EDTA | | 0.20 |
| Erythorbic acid | | 0.50 |

[10] Cetearyl alcohol - Crodacol CS-50, Croda Inc
[11] Trideceth 2 carboxamide MEA - Aminol A 15, Kao Chemicals GmbH
[12] Ceteareth-30 - Eumulgin ™ B 3, Cognis GmbH
[13] Pentasodium pentetate - Versenex 80, Dow Chemicals
[14] Cetearyl Alcohol (and) Ceteareth-20 - Crodex N, Croda Inc
[15] Glyceryl Stearate - Cithrol GMS 0400, Croda Inc
[16] Oleth-10 - Volpo 10, Croda Inc.
[17] Oleth-2 - Volpo N2, Croda Inc.
[18] Stearamidopropyl Dimethylamine - Incromine SB, Croda Inc.
[19] Acrylates/C10-30 alkyl acrylate crosspolymer, Carbopol ™ Ultrez 20, Noveon Inc.
[20] Magnesium Stearate - Radiastar ™ 1100, Oleon NV
[21] Diethylhexyl sodium sulfosuccinate, Geropon SS-0-75, Rhodia Inc.
[22] VP/VA copolymer - Luviskol ™ VA73E BASF Corporation
[23] Polydecene - Puresyn ™ 1000 ExxonMobil Chemical Company
[24] Sodium lauryl sulfate - Empicol LX32, Albright and Wilson UK Ltd
[25] Cetearyl alcohol/hydroxyethyl behenamidopropyl dimonium chloride/hexylene glycol, Incroquat Behenyl HE, Croda Inc.
[26] Cocamide MEA, Amidex CME, Rhodia.
[27] Dilinoleic acid, Empol 1008, Cognis Corporation
[28] Disodium wheatgermamphodiacetate, Mackam 2W, McIntyre Group Ltd
[29] Linoleamidopropyl dimethylamine dimer dilinoleate, Necon LO-80, Alzo/Bernal Chemical
[30] Stearamide MEA Rewomid S280, Degussa Care and Surface Specialities In another example a dying composition containing direct dyes as indicated in table 8, formulation (a4), may be used directly with no preparation step required.

In a further example, a dying composition comprising oxidative dyes was prepared by mixing in a bottle by vigorous shaking about 60 g of formulation (a5), in table 7, with about 60 g of formulation (b5), in table 7.

TABLE 7

Dyeing composition (a4) and formulations (a5) and (b5) which can be mixed to form a dying composition comprising oxidative dyes. All ingredients are indicated in grams.

| Ingredients | (a4) | a5 |
|---|---|---|
| Water | 95.49 | 66.45 |
| Ammonium hydroxide 31.9% solution | | 6.00 |
| Oleth-10 [31] | | 4.00 |
| C12-15 Pareth-3 [32] | | 2.50 |
| Steareth-21 [33] | | 4.00 |
| Dilinoleic Acid [34] | | 3.50 |
| Cocamide MEA [35] | | 4.00 |
| Behentrimonium Chloride [36] | | 2.60 |
| Linoleamidopropyl Dimethylamine Dimer Dilinoleate [37] | | 3.00 |
| Erythorbic Acid | | 0.40 |
| Sodium Sulfite | | 0.25 |
| EDTA acid | | 0.05 |
| Sodium Sulfate | | 0.50 |
| M-Aminophenol [38] | | 0.50 |
| 1-Naphthol [39] | | 0.25 |
| Resorcinol [40] | | 1.00 |
| P-Phenylenediamine [41] | | 0.75 |
| P-Aminophenol [42] | | 0.25 |
| HC Yellow No. 2 [43] | 0.20 | |
| Disperse Black 9 [44] | 0.05 | |
| HC Red No. 3 [45] | 0.15 | |
| Disperse Violet 1 [46] | 0.05 | |
| Erythorbic Acid | 0.025 | |
| Citric Acid | 0.50 | |
| Ethanolamine | 2.50 | |
| Carbopol 956 [47] | 0.83 | |
| HC Orange No. 1 [48] | 0.205 | |
| **Ingredients** | | **(b5)** |
| Water | | 82.84 |
| Hydrogen peroxide (35% active) | | 17.14 |
| Etidronic Acid | | 0.02 |

[31] Oleth-10 - Volpo 10, Croda Inc.
[32] C12-15 Pareth-3, Neodol 25-3, Shell Chemical Company
[33] Steareth-21 - Cromul EM1207, Croda Inc
[34] Dilinoleic Acid - Empol 1008, Cognis Corporation
[35] Cocamide MEA - Amidex CME, Rhodia.
[36] Behentrimonium Chloride - Incroquat Behenyl TMC-85 - Croda Inc.
[37] Linoleamidopropyl Dimethylamine Dimer Dilinoleate - Necon LO-80, Alzo/Bernal Chemical
[38] M-Aminophenol - Rodol EG, Jos. H. Lowenstein & Sons, Inc.
[39] 1-Naphthol - Rodol ERN, Jos. H. Lowenstein & Sons, Inc.
[40] Resorcinol - Rodol RS, Jos. H. Lowenstein & Sons, Inc.
[41] P-Phenylenediamine - Rodol D, Jos. H. Lowenstein & Sons, Inc.
[42] P-Aminophenol Rodol P Base(Jos. H. Lowenstein & Sons, Inc.
[43] HC Yellow No. 2 - Velsol Yellow 2, Clariant Corporation
[44] Disperse Black 9 - Lowadene Black 9, Jos. H. Lowenstein & Sons, Inc.
[45] HC Red No. 3 - Velsol Red 3, Clariant Corporation
[46] Disperse Violet 1 - Lowadene Violet 1, Jos. H. Lowenstein & Sons, Inc.
[47] Carbopol 956, Noveon Inc.
[48] HC Orange No. 1 - Colorex HCO1, Chemical Compounds Inc.

The kit according to the present invention may further comprise additional components such as means to select the hair strands, combs or brushes, gloves, caps with holes, tweezers, tongues, hooks or combination thereof.

The kit according to the present invention may further comprise instructions for using at least one component of the kit according to the invention. Preferably, said kit may comprise instructions for consumers indicating how to load and/or use components of said kit, said instructions being recorded in any type of media such as the package of the kit itself, paper material, compact disk, DVD, website address, or the dispensing means and/or said applicator (1) itself.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments or the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An applicator for applying a hair treatment composition to the hair comprising a plate and a containment portion;

wherein said plate has a perimeter, a substantially flat internal surface and an external surface; wherein said containment portion comprises a base and a wall, said wall emerging from said base and extending upwardly, said wall having a rim and said rim defining an opening and an internal volume of said containment portion;

wherein said plate and said containment portion are movably joined by a connection so that said applicator may alternate between a closed state and an open state, wherein when said applicator is in a closed state, said substantially flat internal surface of said plate is in a juxtaposed relationship to said opening of said containment portion and wherein when said applicator is in an open state, said substantially flat internal surface of said plate is in a distal relationship to said opening of said containment portion;

wherein a first fin projects independently from said substantially flat internal surface of said plate and forms with said substantially flat internal surface an acute angle $\alpha$ of from about 25° to about 55°; wherein said first fin extends for an average first length (L1) of from about 1 mm to about 50 mm; wherein said first fin comprises a proximal edge and a free distal edge; wherein said proximal edge is attached to said substantially flat internal surface of said plate.

2. The applicator according to claim 1, wherein a second fin projects independently from said first fin from said substantially flat internal surface of said plate and independently forms with said substantially flat internal surface an acute angle $\beta$ of from about 25° to about 55°; wherein said second fin extends independently from said first fin for an average second length (L2) of from about 1 mm to about 50 mm; wherein said second fin comprises a proximal edge and a distal edge; wherein said proximal edge is attached to said substantially flat internal surface of said plate.

3. The applicator according to claim 2, wherein said acute angles $\alpha$ and/or $\beta$ are from about 35° to about 55°.

4. The applicator according to claim 2, wherein said acute angle $\alpha$ and said acute angle $\beta$ are substantially identical.

5. The applicator according to claim 2, wherein said average first length (L1) and said average second length (L2) are substantially identical.

6. The applicator according to claim 2, wherein said first fin and said second fin project independently from said substantially flat internal surface of said plate and wherein said distal edges verge one toward the other.

7. The applicator according to claim 1, wherein said proximal edge of said first fin is substantially parallel to said proximal edge of said second fin.

8. The applicator according to claim 1, wherein said substantially flat internal surface of said plate comprises an axis Y which extends straight from the centre of said substantially flat internal surface of said plate and crosses transversally said connection, and wherein said proximal edge of said first fin, is substantially parallel to said axis Y.

9. The applicator according to claim 1, wherein when said applicator is in closed state, said applicator comprises an average distance (D1) from said substantially flat internal surface of said plate to said rim of said wall of said containment portion, wherein said average distance (D1) is from about 0.5 mm to about 5.0 mm.

10. The applicator according to claim 1, wherein said perimeter of said plate has a substantially identical extension of said rim of said wall of said containment portion.

11. The applicator according to claim 1, wherein said first fin and/or said second fin comprises a flexible material.

12. A method to treat the hair wherein one hair strand are contacted with the applicator according to claim 1.

13. The method according to claim 12, wherein a hair treatment composition is loaded into said applicator, said applicator is positioned at the root-line of said one hair strand, in an open state and then subsequently brought into a closed state, and wherein said applicator is swiped along the length of said one hair strand.

14. A kit comprising at least one applicator according to claim 1 and one or more individually packaged hair treatment compositions.

15. The kit according to claim 14, further comprising instructions for using said applicator.

16. The kit according to claim 14, wherein said one or more individually packaged hair treatment compositions comprises at least a first and a second individually packaged hair treatment composition, wherein said first and second individually packaged hair treatment composition are mixed to form a third hair treatment composition, and wherein said first individually packaged hair treatment composition comprises an oxidizing agent and wherein said second individually packaged hair treatment composition comprises an alkalizing agent.

17. The kit according to claim 16, wherein at least one of said first or second individually packaged compositions comprises a persulfate salt.

* * * * *